United States Patent [19]

Grimm

[11] 4,056,047

[45] Nov. 1, 1977

[54] METHOD AND APPARATUS FOR ASSEMBLING A PACKAGE

[75] Inventor: Wolfgang H. Grimm, Richmond, Va.

[73] Assignee: Brown & Williamson Tobacco Corporation, Louisville, Ky.

[21] Appl. No.: 686,578

[22] Filed: May 14, 1976

[51] Int. Cl.[2] ..... B31B 13/00

[52] U.S. Cl. ..... 93/49 M; 93/39 R; 93/36 DA

[58] Field of Search ..... 93/39 R, 39.1 P, 39.1 R, 93/40, 43, 49 R, 49 M, 55.1 P, 55.1 R, 55, 36 C, 36 DA; 229/44 CB, 9, 11, 19, 20; 206/262, 267; 53/183

[56] References Cited

U.S. PATENT DOCUMENTS

| | | | |
|---|---|---|---|
| 2,358,789 | 9/1944 | Carruth | 93/52 |
| 2,990,994 | 7/1961 | Hackmyer | 229/19 |
| 3,779,140 | 12/1973 | Yamamura | 93/39 R X |
| 3,858,788 | 1/1975 | Phillip, Jr. | 229/44 CB |
| 3,956,865 | 5/1976 | Schmermund | 93/12 C X |
| 3,977,520 | 8/1976 | Grimm | 229/44 CB X |

*Primary Examiner*—James F. Coan
*Attorney, Agent, or Firm*—William J. Mason

[57] ABSTRACT

The present invention is a method and apparatus for assembling a package comprising an open-topped receptacle and a slide actuated closure member. The closure member is comprised of a slide portion connected to a closure portion by a hinge portion. The open-top of the receptacle is placed in contact with the closure portion normal to the path of the closure member and affixed thereto while the movement of the closure member is momentarily interrupted. While the closure member is stationary, the slide portion is forced toward the closure portion buckling the hinge portion out of the plane of the closure member. The receptacle is thereafter rotated about the closure portion to contact the buckled hinge and a portion of the slide portion. The slide portion is thereafter wrapped around the receptacle and affixed in a manner allowing reciprocating movement of the slide portion about the receptacle.

44 Claims, 29 Drawing Figures

FIG 19
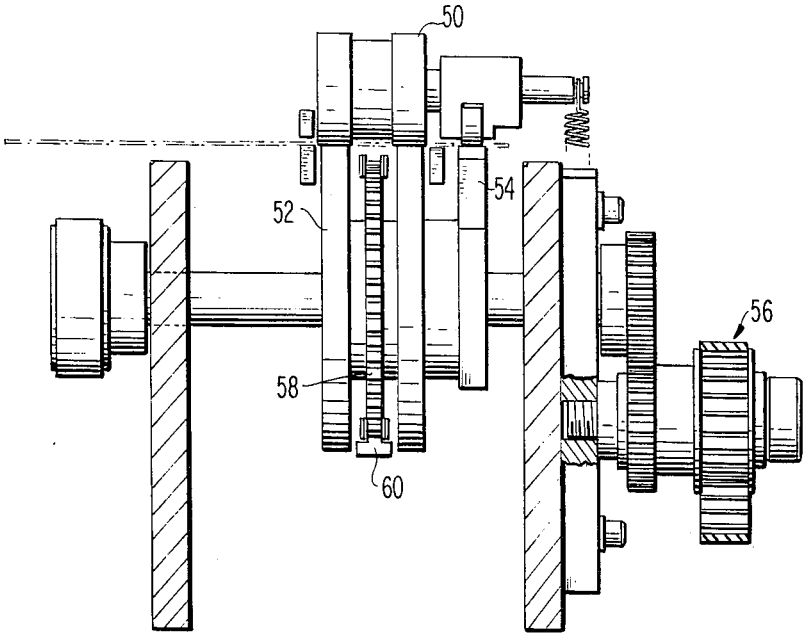
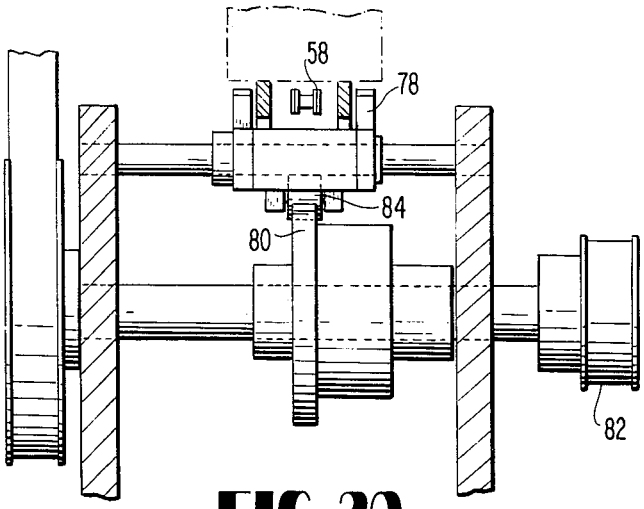
FIG 20
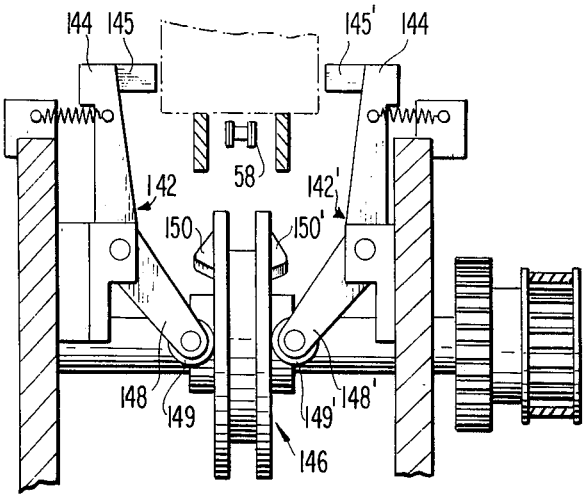
FIG 21
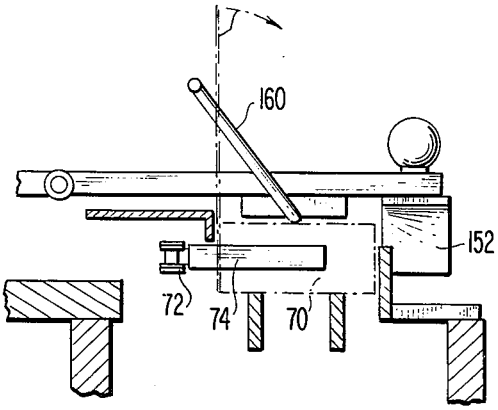
FIG 22

METHOD AND APPARATUS FOR ASSEMBLING A PACKAGE

BACKGROUND OF THE INVENTION

This invention relates to a method and apparatus for assembling a package having a slide actuated closure member attached thereto.

It is a primary object of the present invention to provide an efficient and fully automated means for assembling such packages at commercially feasible production rates.

An additional object of the present invention is to provide a method and apparatus for assembling a package whereby the components may be assembled at desired rates of production with minimum rejections due to damage to the packages or to the contents thereof.

Further objects and advantages of the invention will be set forth in part in the description which follows and in part will be obvious from the description or may be learned by practice of the invention. The objects and advantages of the invention may be realized and attained by means of the instrumentalities and combinations particularly pointed out in the appended claims.

SUMMARY OF THE INVENTION

To achieve the foregoing objects and in accordance with the purpose of the invention as embodied and broadly described herein, the package assembled in the present invention is comprised of an open-topped receptacle and a slide actuated closure member affixed to portions of the receptacle. The closure member is normally formed from a blank and has a closure portion closing the open portion of the receptacle, a slide portion surrounding the receptacle and a rolling hinge portion connecting the slide portion and the closure portion.

To assemble the package, the blank is moved along a path and the open portion of the receptacle is placed in contacting relation with the closure portion, with the receptacle extending normally from the path along which the blank has been moved. Portions of the blank are then affixed to the receptacle while the closure portion is abutted momentarily to compress and buckle the rolling hinge portion. The buckling of the rolling hinge portion moves the hinge portion out of the plane of the path along which the blank is moved. The receptacle is then rotated into a contacting relation with the rolling hinge portion and the slide portion of the closure member is thereafter wrapped around the receptacle and affixed to provide for reciprocating movement of the slide portion toward and away from the open portion of the receptacle.

Preferably, the blanks are moved horizontally with the receptacles being vertically disposed above the drive means. The blanks are also preferably moved in such a manner that the closure portion precedes the remainder of the blank. It is also preferred that the drive means be disposed beneath the blanks and engage the trailing edge of the slide portion of the closure member.

The apparatus of the present invention assembles the previously described package. A portion of the apparatus supplies individual blanks. The blanks are conveyed along a path through the apparatus. The open-topped receptacles are transported to the path of the blank through the apparatus. Means are provided for placing the open portion of the receptacles into contacting relation to the closure portion of the blanks. Means are provided to buckle the hinge portion out of the plane of the path of the movement of the blank. Means in the apparatus rotate the receptacle about the closure portion to place one side of the receptacle in contact with the hinge portion, the hinge portion being positioned between the receptacle and the slide portion. Additional elements of the apparatus wrap the slide portion around the receptacle and affix the slide portion in that position.

Preferably, the closure portion precedes the remainder of the blank during movement. It is also preferable to interrupt the movement of the blank to place the receptacle in contact with the closure portion then commence movement of the remainder of the blank while holding the closure portion stationary to buckle the hinge portion out of the plane of the movement path. When the closure is released to move along the path the receptacle rotates into contact with the hinge portion that is now positioned between the receptacle and the slide member.

Preferably, the closure portion of the blank includes two rectangular top flaps, the first of the top flaps preceding the second in the blank movement path, with the top flaps disposed to be joined along the line of common dimension by a first fold line. The apparatus utilized with such a preferred closure member includes means for folding the first top flap along the fold line to place the first top flap over the second top flap and affixing it thereto.

It is also preferred that the blank be initially planar with the closure portion further including two opposite end flaps affixed at each lengthwise extremity of the second top flap along opposite end fold lines. The end flaps each have a trailing side flap affixed to the end flap by a side fold line. The side fold lines are at 90 degrees to the end fold lines and parallel to the first fold line when the blank is planar. The receptacle in this preferred embodiment includes a rear wall disposed to contact the hinge portion and a front wall connected to the rear wall by two opposite end walls. The apparatus for operating on such a preferred package includes means for elevating the end flaps to a vertical position in contact with the end wall of the receptacle when the receptacle is placed in contact with the closure portion. The apparatus further includes means for folding the trailing side flaps along the side fold lines 90° from the end flaps, placing the trailing side flaps in contact with the portion of the rear wall of the receptacle adjacent its open portion.

It is also preferred that the means for momentarily engaging the closure portion to buckle the hinge portion comprise a pivotally mounted engaging arm below the blank and a cam rotating synchronous with the conveying means in contact with the engaging arm to move the engaging arm vertically upward in response to the position of the cam. The upward vertical movement of the engaging arm places the arm in engagement with the closure portion of the blank.

Preferably, the means for placing the receptacles normal to the path of the blanks moving through the apparatus comprises a vertically disposed guide member for confining a plurality of the receptacles in a downward progression with the receptacles oriented with then open portions down and adjacent the bottom wall of the next receptacle. The guide member preferably has upper and lower extremities with the lower extremity terminating at a distance above the conveying means allowing passage of the blanks thereunder. The upper extremity of the guide member is disposed to receive individual receptacles. A first receptacle drive means is adjacent the upper extremity and places individual receptacles within the guide member.

Preferably, the first receptacle drive means is a substantially circular rotationally driven disc having an indented circumferential surface. The disc is driven synchronous with the conveying means. Receptacle supply means supply receptacles to the indentation on the disc with rotation of the disc moving the receptacles to the guide member within the indentation.

In a further preferred embodiment, a second receptacle drive means on the guide member drives the receptacles through the guide member with a driven elastomeric roller contacting one surface of the receptacles. The second drive means is also synchronously driven with the rotationally driven disc.

BRIEF DESCRIPTION OF THE DRAWINGS

The accompanying drawings which are incorporated in and constitute a part of the specification illustrate one embodiment of the invention and together with the description, serve to explain the principles of the invention.

FIG. 19 is a partial cross-sectional end view of the conveying means adjacent the dispensing means illustrating the means for placing the blank into engagement with the conveying means.

FIG. 20 is a partial cross-section of an embodiment of the apparatus depicting the means for momentarily abutting the closure portion of the blank.

FIG. 21 is a partial cross-section of an embodiment of the apparatus depicting the means of folding trailing side flaps on the closure portion of the blank.

FIG. 22 is a partial cross-section of an embodiment of the apparatus depicting the means for deflecting portions of the slide portion around the receptacle.

DESCRIPTION OF THE PREFERRED EMBODIMENT

Reference will now be made in detail to the present preferred embodiment of the invention, an example of which is illustrated in the accompanying drawings.

Figure 1:
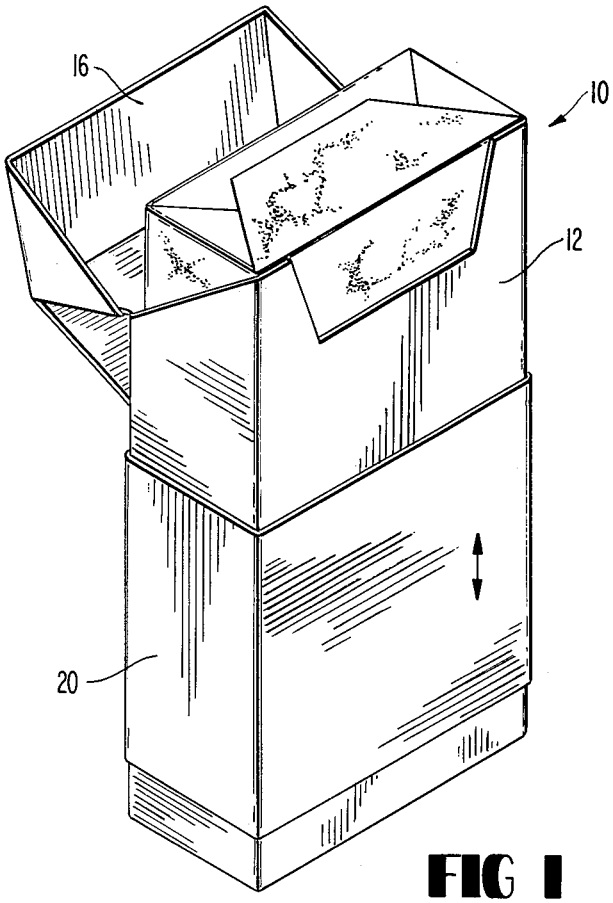
FIG. 1 is a perspective view of the package assembled by operation of the invention.
Figure 2:
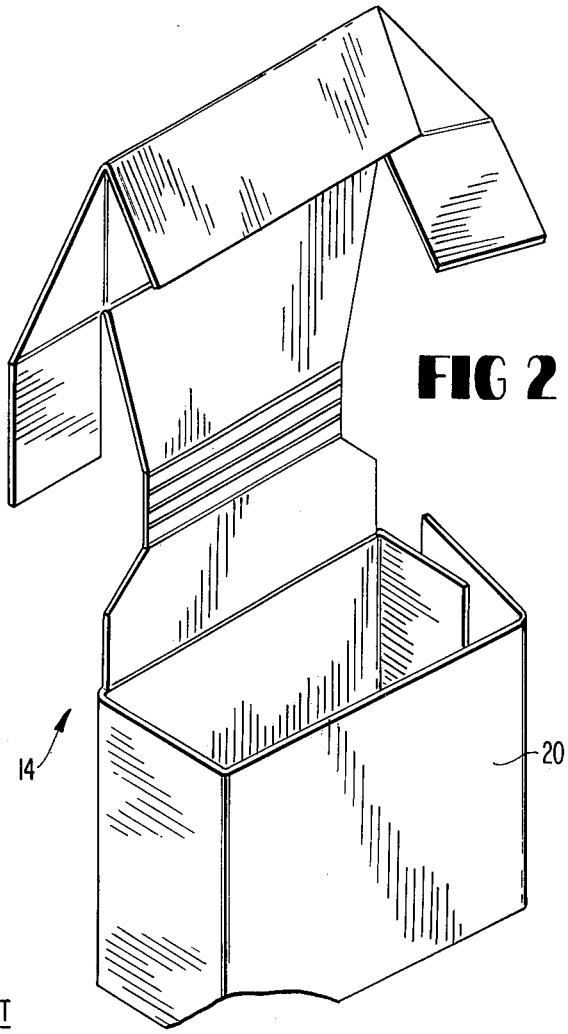
FIG 2 PRIOR ART
FIG. 2 is a perspective view of the closure member.
Figure 4:
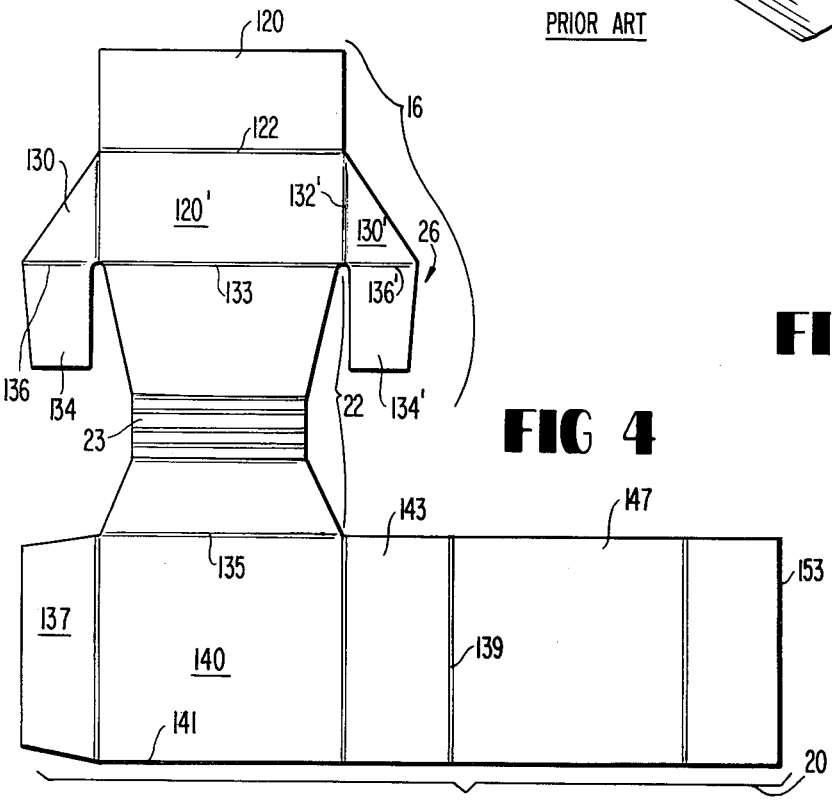
FIG. 4 is a view of a planar blank from which the closure member of FIG. 2 is made.
Figure 3:
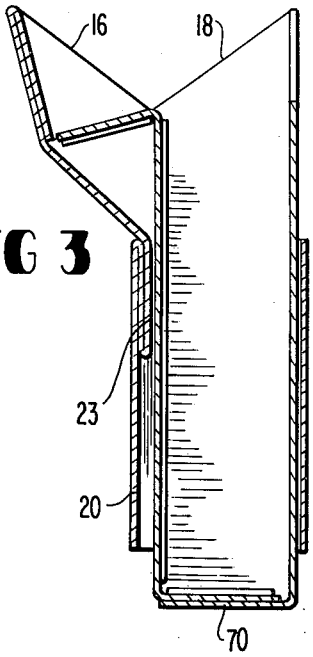
FIG. 3 is a cross-sectional view of the package of FIG. 1.

It is the function of the present invention to construct a package, an embodiment of which is shown in FIG. 1. The package 10 is comprised of an open-topped receptacle 12 and a slide actuated closure member 14. As is most clearly depicted in FIG. 3, the closure member 14 is comprised of a closure portion 16 disposed to fit over the open portion 18 of the open-topped receptacle 12. A slide portion 20 surrounds the receptacle 12 and a rolling hinge portion 22 connects the slide member 20 and the closure portion 16. As depicted in FIG. 4, the closure member is preferably a planar blank, the configuration of which is shown here by a preferred embodiment that will be more fully described when the apparatus operating on additional portions of the blank is disclosed.

In accordance with the invention, means for supplying the blanks individually are provided, with the supply means dispensing the blanks.

As here embodied and depicted in FIGS. 7 through 11, a dispensing means, generally 24, is provided for dispensing individual planar blanks 26 to conveying means to be hereinafter disclosed. As depicted in FIGS. 7, 8, 9 and 10, a storage frame 28 maintains each of the blanks 26 in a horizontal position in a vertical stack. A blank grasping device 30 is disposed beneath the stack for selectively engaging the bottommost blank 26' from the stack. The blank grasping device 30 has a portion (grasping member 32) for contacting the bottommost blank 26' with orifices 34 for selectively applying a vacuum to the bottommost blank 26'.

This embodiment provides a selective means of affixing the grasping member 32 to the bottommost blank 26' of the stack. An elongated actuating member 36 is linked to the grasping member 32 for selectively moving the individual blank 26' affixed to the grasping member to a predetermined location.

It is preferred that the actuating member 36 be driven by means synchronously linked to the conveying means moving the blanks through the apparatus. As here embodied, the elongated actuating member 36 includes a roller 38 at the extremity of the actuating member 36 opposite the blank contacting member 32. The dispensing means 24 includes a guide slot 40 surrounding the roller 38 for imparting vertical and horizontal movement to the grasping member 32 as the roller 38 is moved within the guide slot 40.

A driving member 42 engages the actuating member 36 between the blank grasping member 32 and the roller 38 for driving the roller within the guide slot 40. As here embodied, the driving member 42 is comprised of a guide member 43 and a sliding member 46 engaged thereon. One extremity of the guide member 43 is mounted at pivot 47 to the dispensing means 24 with the sliding member 46 slideably engaged to the elongated guides 44 as well as slideably engaged to the elongated actuating member 36 along its length. The elongated guides 44 constrain the sliding member 46 in a generally horizontal direction while the actuating member 36 constrains the sliding member in a generally vertical direction. A first rotating cam 48 contacts the driving member 42.

Figure 6:
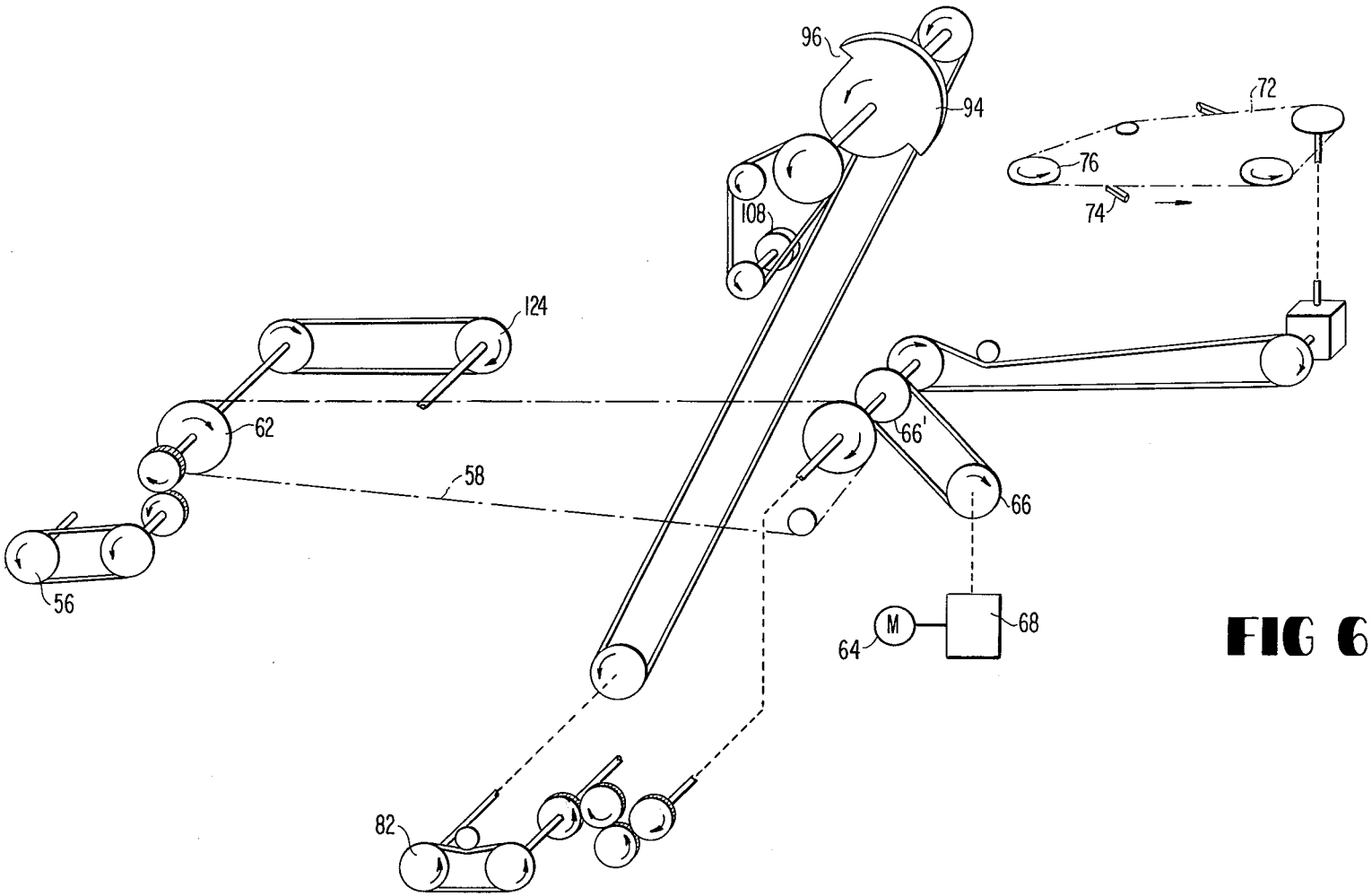
FIG. 6 is a schematic view of the drive system of the apparatus of the present invention.
Figure 7:
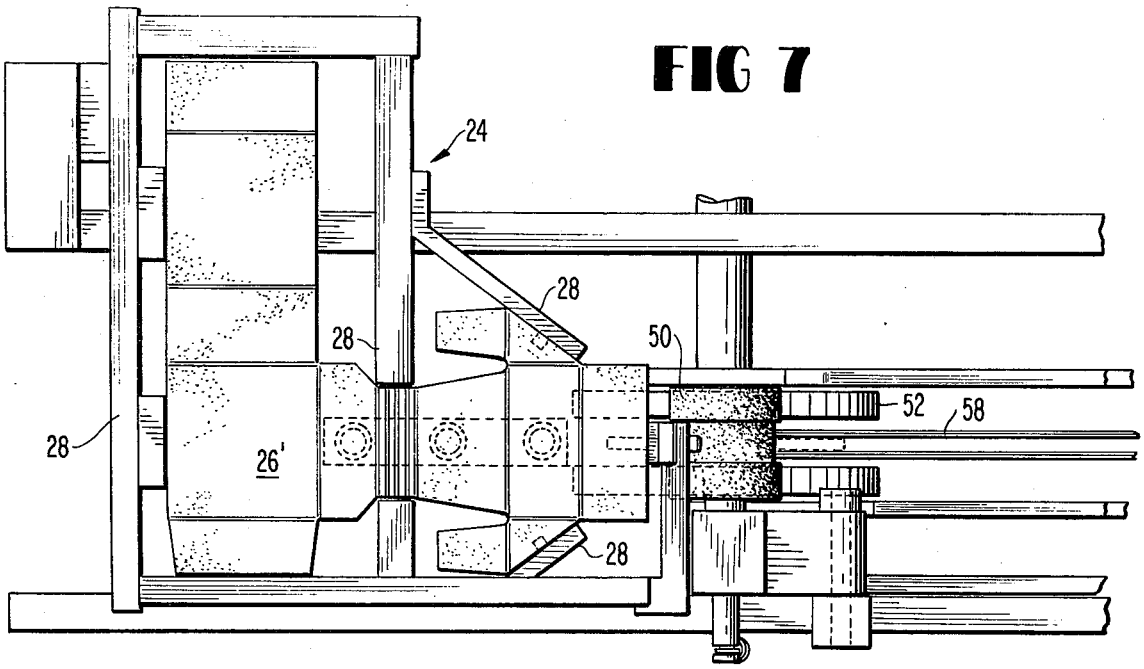
FIG. 7 is a top view of the blank dispensing means.

As depicted schematically in FIG. 6, the cam 48 is driven by sprocket 49 which is synchronously engaged to the conveying means. The cam 48 is disposed to move the sliding member 46 on the elongated guide 44 thereby moving the actuating member 36 in response to the position of the sliding member 46 on the cam 48 and the shape of the guide slots 40. As is most clearly depicted in FIGS. 8 and 9, the rotation of the cam 48 and the shape of the guide slot 40 provide the blank grasping member 30 with a generally vertical and lateral motion. The downward motion of the grasping member 32 places an associated blank in a position to be extracted from the remainder of the blanks in the stack.

Figure 8:
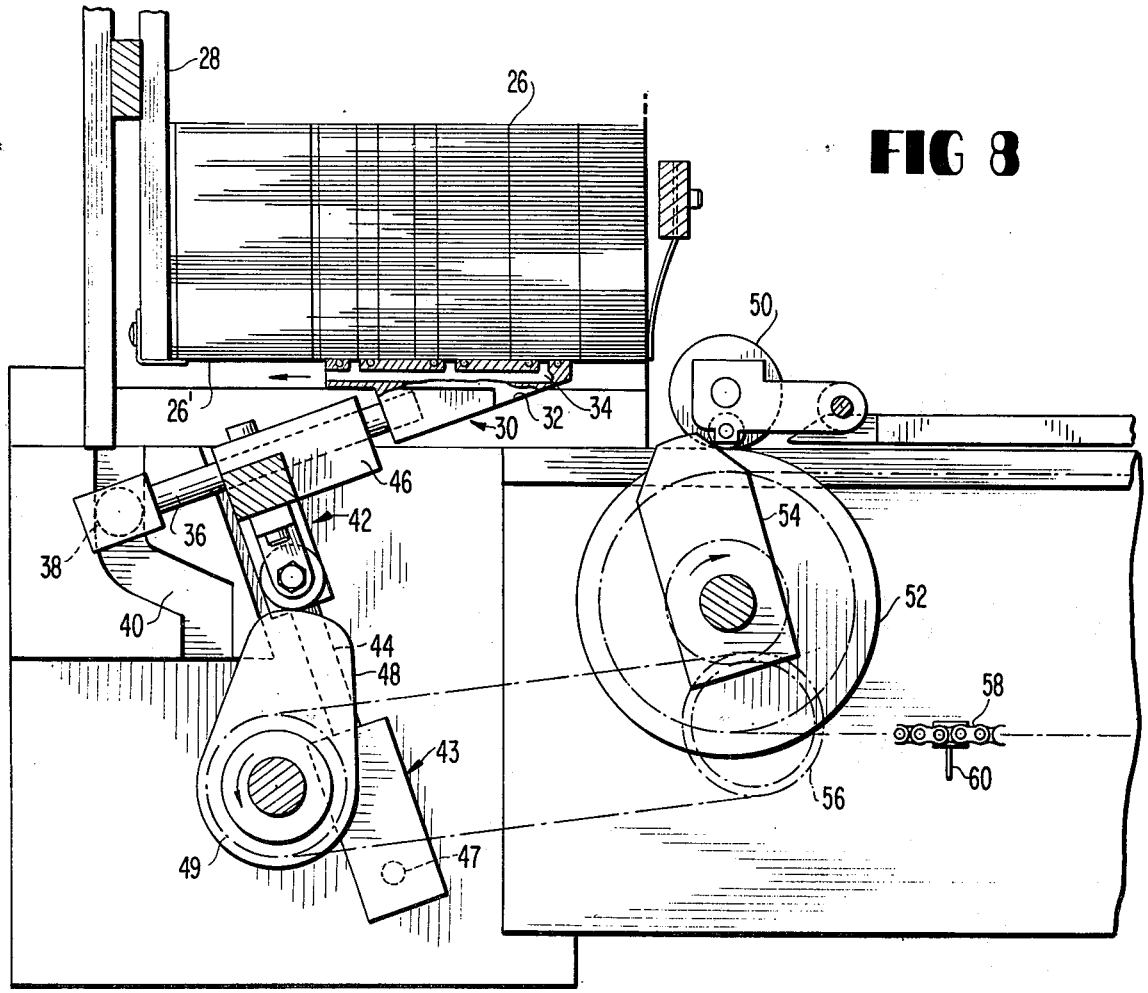
FIG. 8 is a partial cross-sectional side view of the embodiment of FIG. 7.
Figure 9:
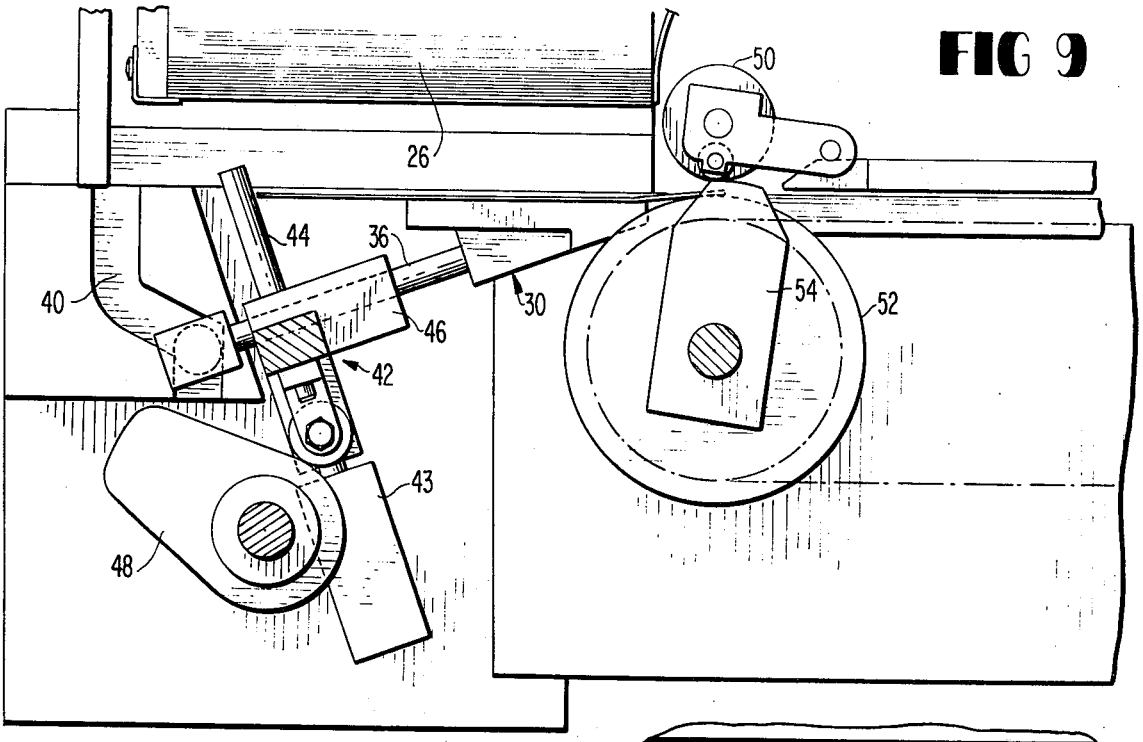
FIG. 9 is a partial cross-sectional side view of the embodiment of FIG. 8 with the components in different sequence in the operation of the dispensing means.
Figure 11:
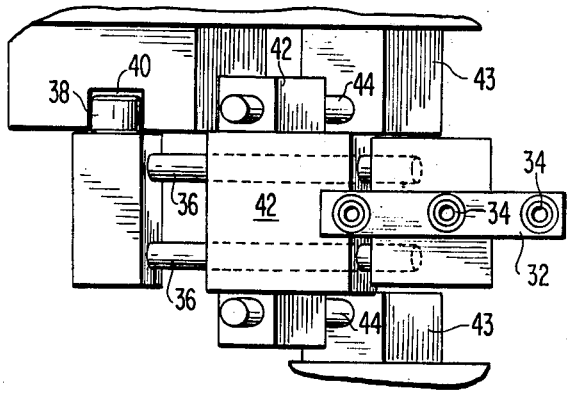
FIG. 11 is a partial cross-sectional top view of the embodiment of FIGS. 7 through 10.
Figure 10:
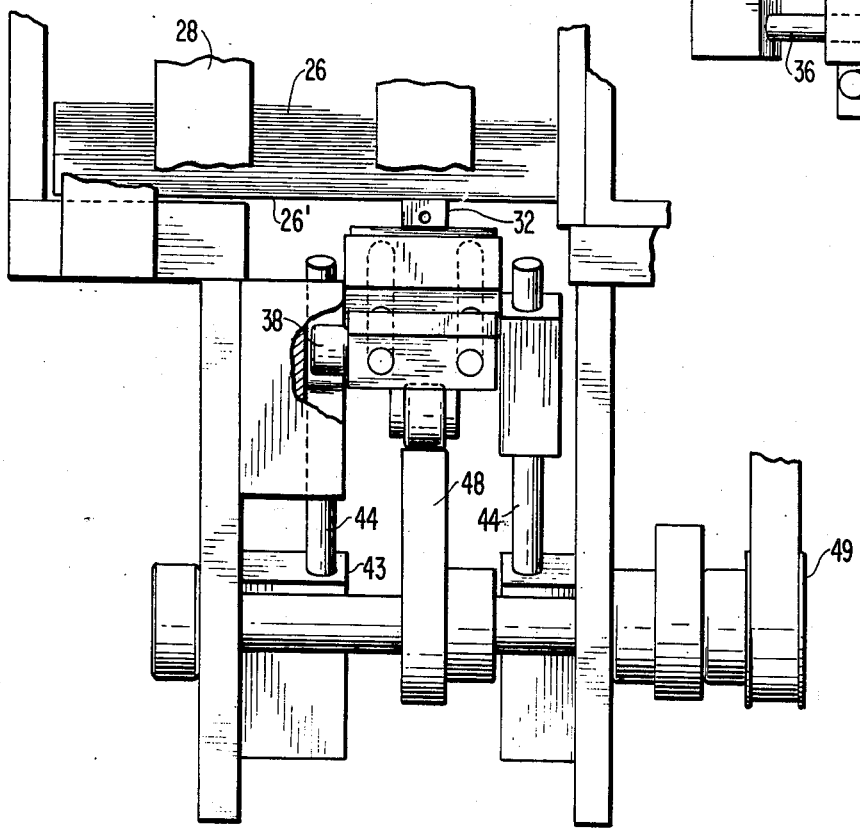
FIG. 10 is an end view of the embodiment of FIGS. 7 and 8.

In accordance with the invention, means at the predetermined determined lateral location of the bottommost blank 26' are provided for placing the blank into engagement with the conveying means. As here embodied, and most clearly depicted in FIGS. 7, 8, 9 and 19, the means for moving the individual blank comprise a pivotally mounted roller 50 for engaging and transporting the blank 26' from the blank contacting portion 32 into engagement with the conveying means. The roller 50 is intermittently engaged on roller 52 with the blank 26' engaged at the nip of the roller 50 and roll 52. As is depicted in FIGS. 6, 8 and 19, a second cam 54 is synchronously driven with the roll 52 and the first cam 48 by sprocket 56, the second cam 54 intermittently raising the roller 50 and allowing the grasping device 30 to insert the blank 26' between the roller 50 and roll 52 prior to the roller 50 engaging the blank 26'. The blank dispensing means embodied herein provides a reliable means of introducing a single blank to the conveying means to be hereinafter disclosed.

The dispensing means disclosed engages the surface of the blanks thereby making the dispensing means adaptable to various blanks independent of their edge configuration. In addition, in devices where dispensing means engage the edges of the blanks such devices are prone to multiple feeding, frequent adjustment and limited adaptability to various blank shapes. The disclosed dispensing means is not similarly limited.

Figure 5:
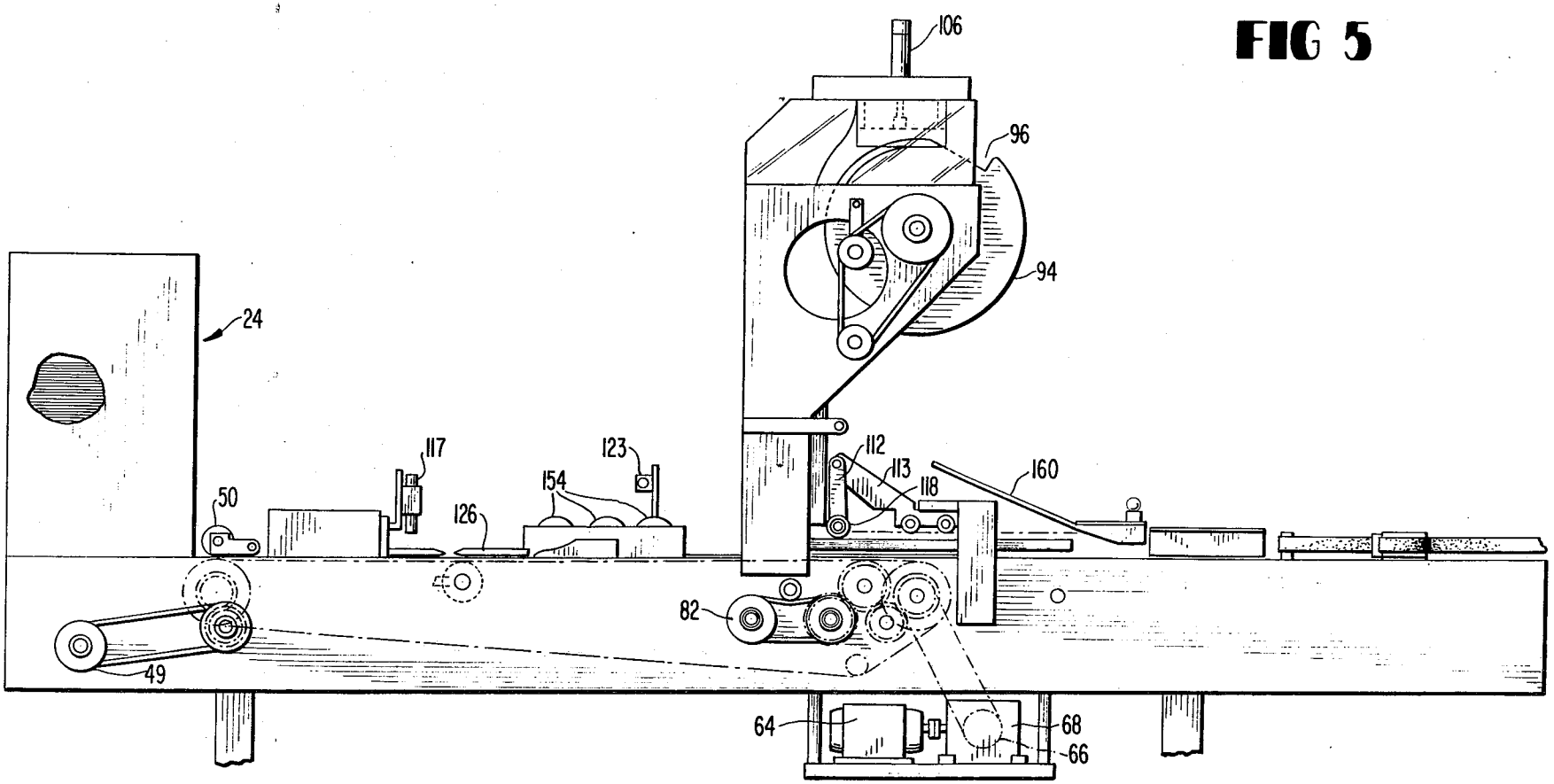
FIG. 5 is an overall side view of the apparatus of the present invention.

In accordance with the invention, means are provided for conveying the blanks along a path through the apparatus by engaging the slide portion 20 of the blank 26'. As here embodied and depicted in FIGS. 5, 6, 8, 19 and 23, the conveying means comprise a chain drive with a driven chain 58 having affixed thereon a plurality of projections 60 for engaging an edge of the slide portion 20 of the closure member 14. The projections 60 engage the slide portion 20 of the blank 26' and convey the blank 26' through the apparatus continuously along the path indicated by the arrow in the FIG. 5.

As depicted herein the chain 58 is disposed in a linear path between two main sprockets 56 and 62. Since the majority of operations on the package must be done in relation to the position of the package within the apparatus the main drive of the conveying means is utilized to drive the other apparatus components. The drive for the main sprockets is provided by the motor 64 through auxiliary drive sprockets 66 and 66' and gearbox 68. The drive for the dispensing means and its associated apparatus has been previously disclosed and the remainder of the drive system depicted in FIG. 5 will be disclosed when dealing with the specific subsystems utilizing a drive synchronous with the motion of the chain 58.

Figure 24:
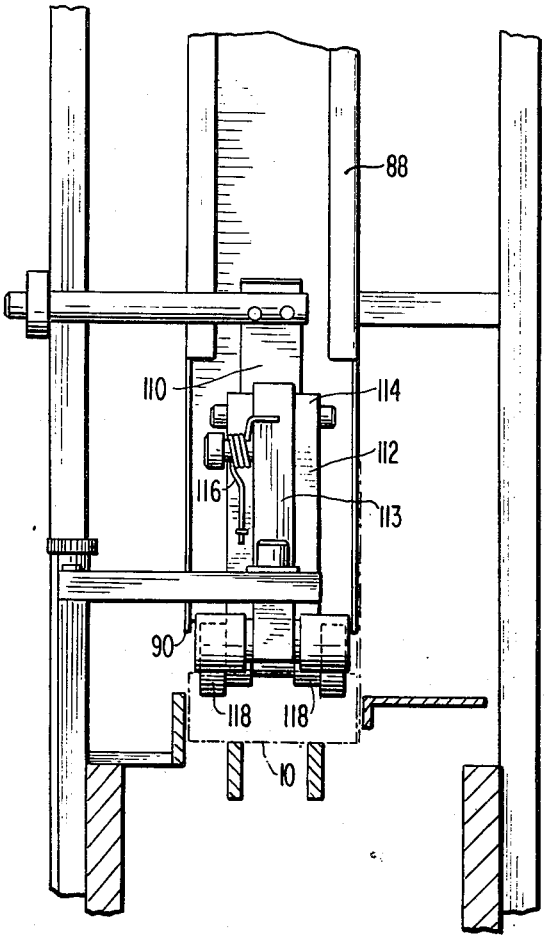
FIG. 24 is an end view of the embodiment depicted in FIG. 23 as viewed from A—A.
Figure 26:
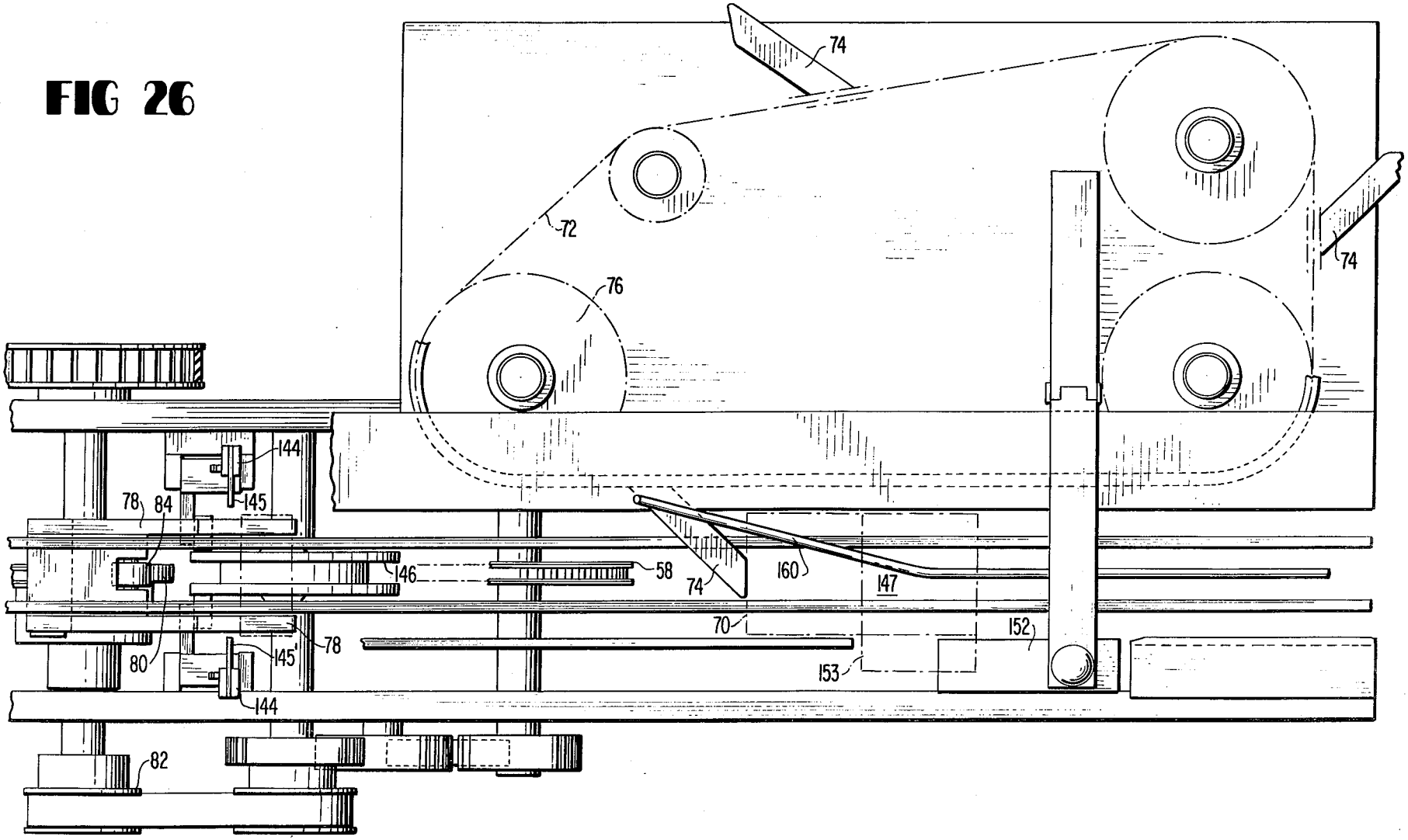
FIG. 26 is a top view of an embodiment of the apparatus utilizing a second drive means.
Figure 28:
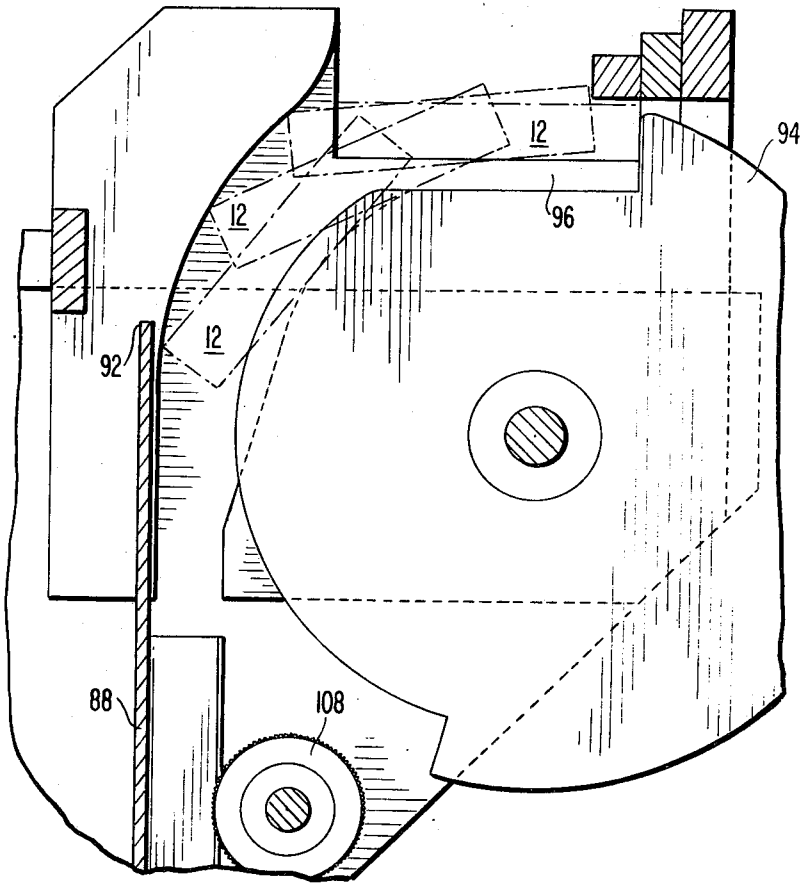
FIG. 28 is an enlarged view of a portion of the device depicted in FIG. 23.

After the receptacle has been joined to the closure member, it is preferred that the means of driving the package through the apparatus not bear on the slide portion 20. As shown in FIGS. 6, 22 and 26, a second conveying means engages the bottom 70 of the receptacle 12 when the receptacle is moving along the path after attachment of the receptacle to the closure member 14. The second conveying means moves the package at a greater speed than the blank conveying means as for example, the chain 58. The second conveying means thereby disengages the closure member 14 from the first blank conveying means without marring the slide portion 20. As depicted in FIGS. 6 and 24, the second conveying means comprises a chain driven synchronous with the blank conveying means with a second chain 72 including a plurality of spaced receptacle engaging members 74 affixed on the chain 72.

Preferably, the chain drive of the second conveying means includes a sprocket 76 adjacent the location where the receptacle engaging member 60 engages the receptacle 12. The extremity of the receptacle engaging members 60 is disposed to move in a circular path around the sprocket 76 at a speed in excess of the linear speed of the second chain 72. As depicted in FIG. 24, when the receptacle engaging member (projections 60) contacts the bottom 70 of the package 10 the speed of the receptacle engaging member 74 causes the disengagement of the package 10 from the slide engaging conveying means embodied herein as projections 60 on chain 58.

In accordance with the invention, means are provided for momentarily engaging the closure portion of the blank and stopping its movement for a time sufficient to cause the blank to buckle at the hinge portion, thereby placing the hinge portion out of the plane of the path of movement of the blank.

As here embodied and most clearly depicted in FIGS. 20 and 23, the means of engaging the closure portion of the blank comprise a pivotally mounted engaging arm 78 usually below the blank 26' as it passes through the apparatus. A cam 80 is rotated synchronous with the conveying means by means of sprocket 82. As here embodied, the cam 80 is in contact with the engaging arm 78 through the roller 84. The cam 80 moves the engaging arm 78 vertically upward in response to the position of the roller 84 on the surface of the cam 80 as shown by the indented portion 86 on the surface of the cam 80.

The upward vertical motion of the engaging arm 78 is sufficient to place the arm is engagement with the closure portion 16 of the blank 26 as it passes through the apparatus when the roller 84 is not within the indented portion 86.

Figure 17:
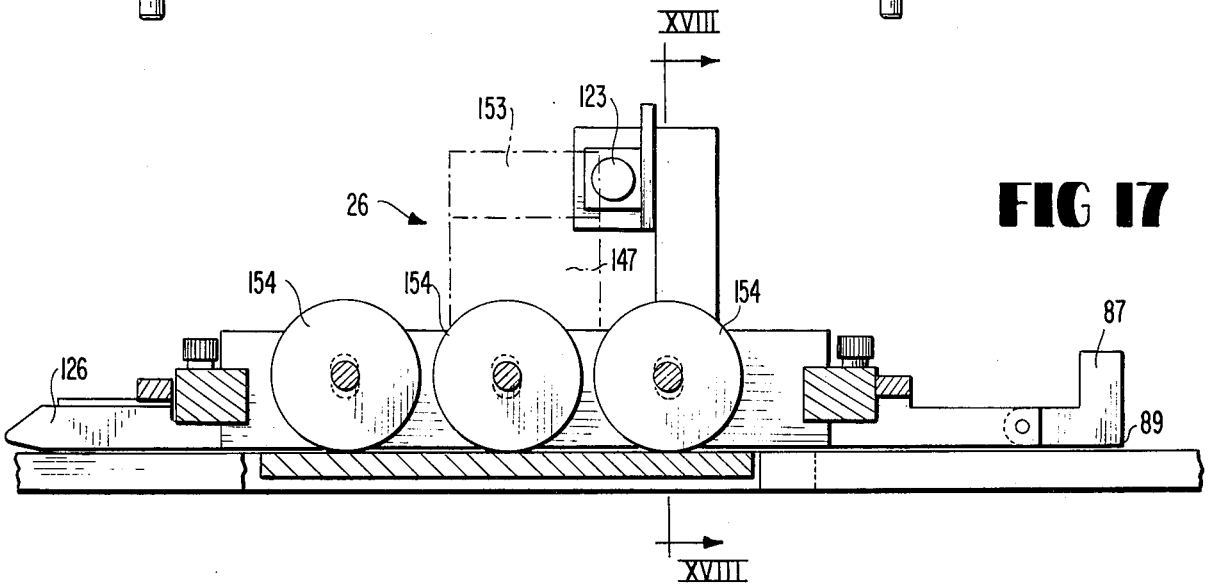
FIG. 17 is a partial cross-sectional side view of the embodiment of FIG. 16.

As here embodied and most clearly depicted in FIG. 17, there is provided means for insuring that the blank buckles at the appropriate location on the blank. The hingeably mounted fold limiting member 87 bears on the upper surface of the blank 26' and when the leading edge of the blank is stopped, the edge 89 of the fold limiting member 87 prevents the blank from buckling except at the desired location. As depicted in FIG. 29(f) the buckling of the hinge portion 22 normally comprises the formation of three folds, one at the fold line 133, the rolling hinge 22 and fold line 135. In order to insure the formation of the buckled section at the appropriate location, the edge 89 of the fold limiting member 87 is disposed to coincide with the fold line 135 when the hinge section 23 is buckled. The presence of one edge of the receptacle 12 on the top panel 120' and also adjacent the fold line 133 on the closure portion 16 forces the buckling of the hinge portion between the fold lines 133 and 135.

In accordance with the invention, means are provided for placing the receptacles normal to the path of the blanks passing through the apparatus with the open top of the receptacle placed in a contacting relation with the closure portion. The placing means is synchronous with the conveying means and the closure engaging means previously disclosed.

Figure 23:
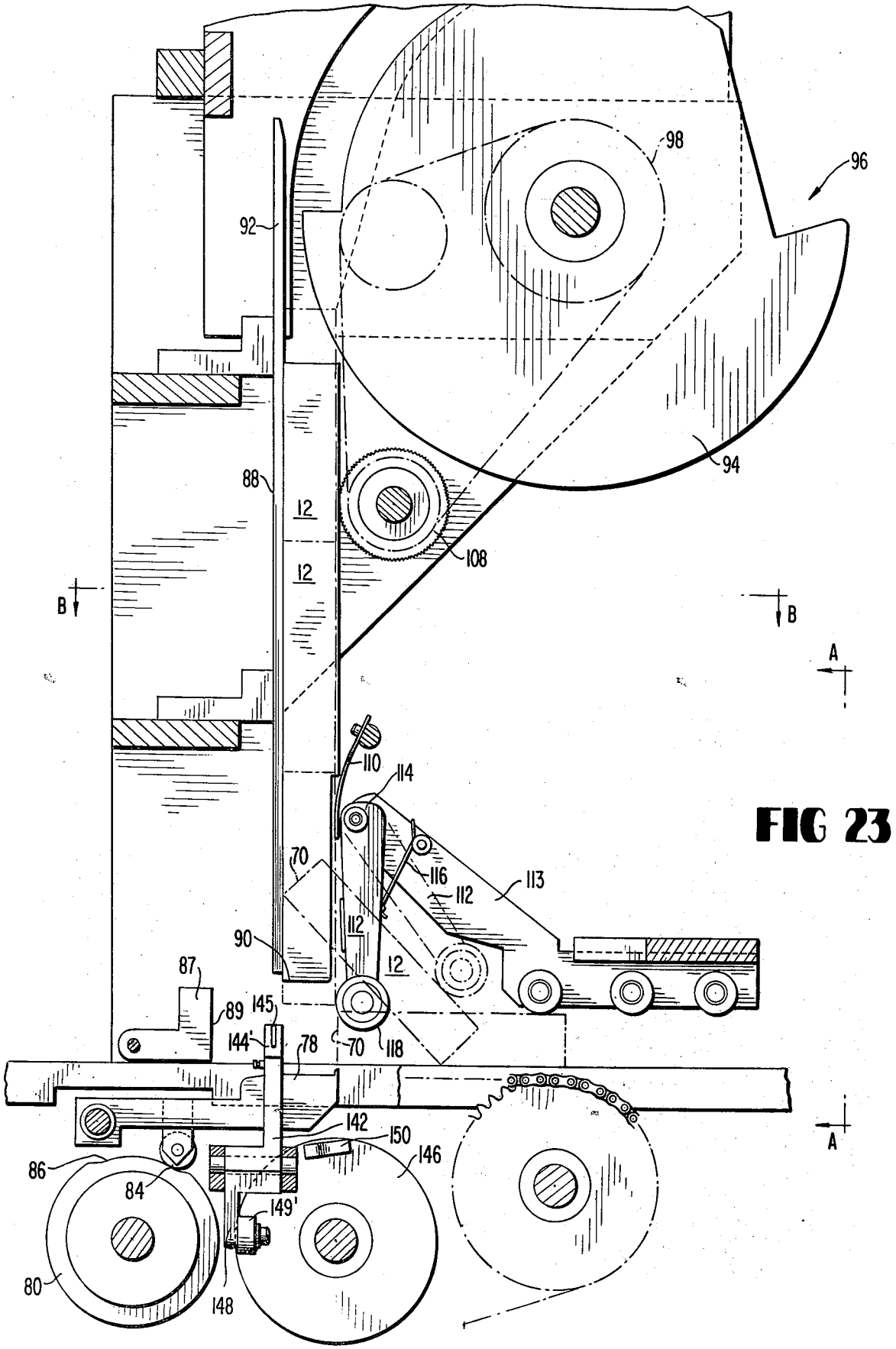
FIG. 23 is a side view of the means for placing the receptacles in contact with the closure portion of the blank.

As here embodied and most clearly depicted in FIG. 23, the means for placing the receptacles normal to the path of blanks passing through the apparatus comprises a vertically disposed guide member 88 for confining a plurality of the receptacles 12 in a downward progression. The receptacles are oriented end to end within the guide member 88 with the open portion 18 of the receptacle oriented downward toward the location of the closure portion 16. The guide member 88 has a lower extremity 90 terminating a distance above the conveying means to allow passage of the closure member thereunder. The upper extremity 92 of the guide member 88 is adapted to receive individual receptacles within the guide member.

A first receptacle drive means, here embodied as a generally circular rotationally driven disc 94, has an indented circumferential surface 96 disposed to engage and transport receptacles placed within the indentation. As depicted in FIG. 6, the disc 94 is driven synchronous with the conveying means. The disc 94 is driven through drive member 98 with the disc drive means including a clutch 100 interposed between the drive member 98 and the disc 94. It is the function of the clutch 100 to interrupt drive to the disc 94 if the force needed to drive the disc is in excess of that required to simply move a receptacle from the supply means into the guide member 88.

Figure 27:
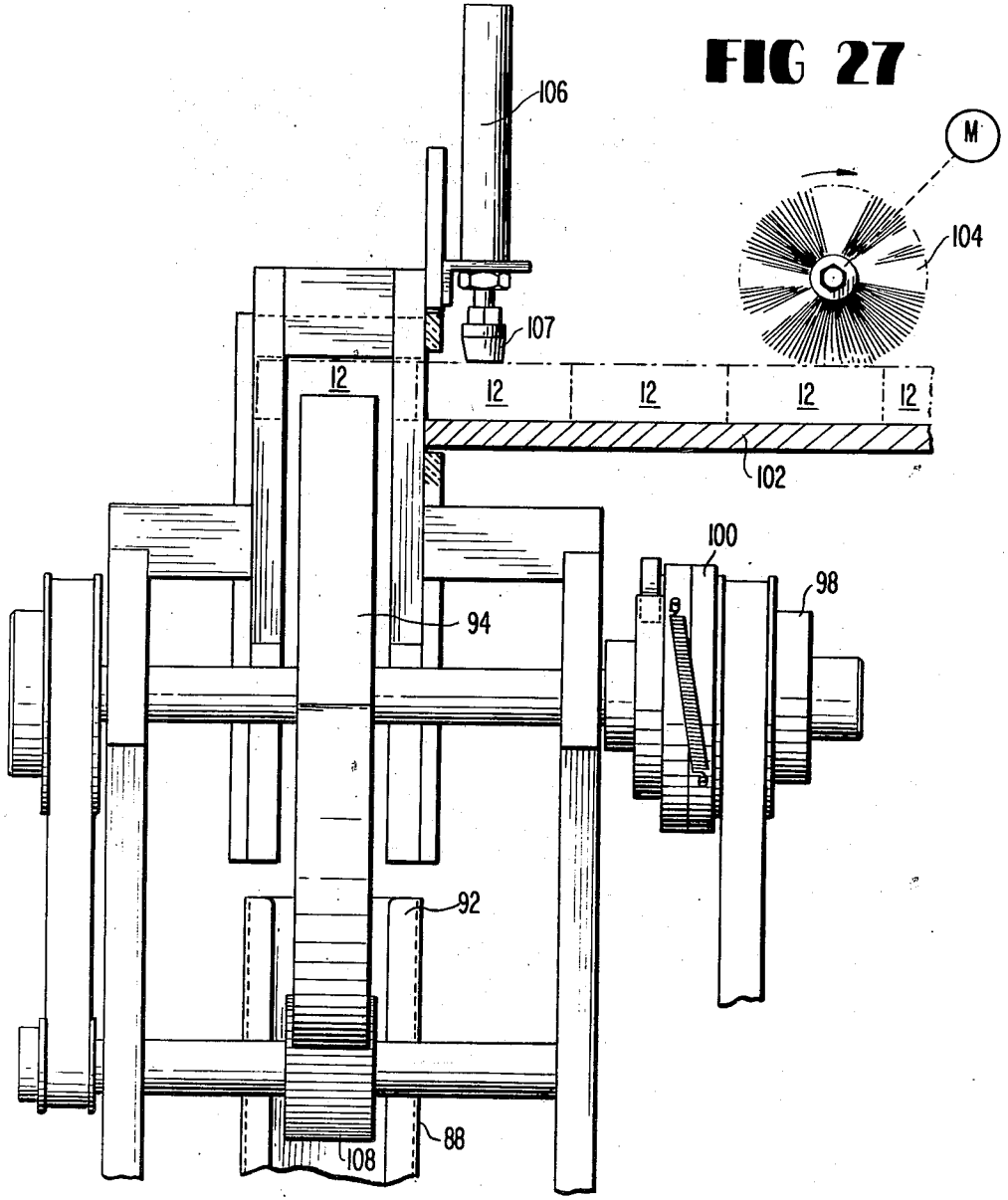
FIG. 27 is a partial cross-section of the means for supplying receptacles to the embodiment depicted in FIG. 23.

Receptacle supply means, an embodiment of which is depicted in FIG. 27, supplied individual receptacles to the indentation 96 on the disc 94 with the rotation of the disc placing the receptacles within the guide member 88.

As here embodied and depicted in FIG. 27, the supply means comprise a support member 102 on which are placed the receptacles 12 in a side by side configuration. An auxiliary drive, embodied here as a brush-like member 104, propels the receptacles 12 toward the location where the disc 94 removes individual cartons from the supply means and places them within the guide member 88. As here embodied, the supply means includes a pneumatic stop 106 that can selectively move to interrupt the supply of receptacles 12 to the disc 94 in response to conditions in other portions of the apparatus. The primary function of the pneumatic stop 106 is to interrupt the supply of receptacles 12 if detecting means within the other portions of the apparatus indicate an interruption in the supply of blanks 26 passing through the apparatus. As depicted in FIG. 27, the pneumatic stop 106 includes a receptacle engaging member 107 (shown in an activated condition) that contacts and interupts the supply of receptacles 12 to the disc 94 when activated.

Preferably, there is provided a second receptacle drive means on the guide member 88 for driving the receptacles downward through the guide member. As here embodied and depicted most clearly in FIG. 23, the second drive means comprises an elastomeric roller 108 contacting one surface of the receptacle. As depicted in FIGS. 6 and 23, the second receptacle drive means is driven synchronously with the driven disc 94.

The primary means of driving the receptacles through the guide member 88 is the disc 94 placing a receptacle end to end with the receptacles previously in the guide member 88 and by continued rotation of the disc forcing the receptacles down through the guide member and into contact with the closure portion 16 of the blank 26. It is preferred however that when the supply of receptacles to the disk is interrupted, the secondary receptacle drive means no longer force the receptacles through the guide member 88. This is accomplished by placing the elastomeric roller 108 at a position along the guide member 88 to contact the junction of two adjacent receptacles, thereby providing an insufficient drive on either receptacle to move the receptacles through the guide member.

It is also preferred to provide means on the guide member 88 to prevent movement of the receptacles through the guide member solely due to the influence of gravity. As here embodied, and depicted in FIG. 23, a spring 110 contacts the one surface of the receptacles with the tension in the spring sufficient to restrain movement of the receptacles within the guide member. In such an embodiment, the only means of moving the receptacles 12 through the guide member 88 is the action of the disc 94 or the elastomeric roller 108 which may be controlled to prevent the placement of the receptacles on the closure member when conditions warrant.

In accordance with the invention, there are provided means for rotating the receptacle about the closure portion to place one side of the receptacle in contact with the hinge portion and the underlying portion of the slide portion.

Figure 25:
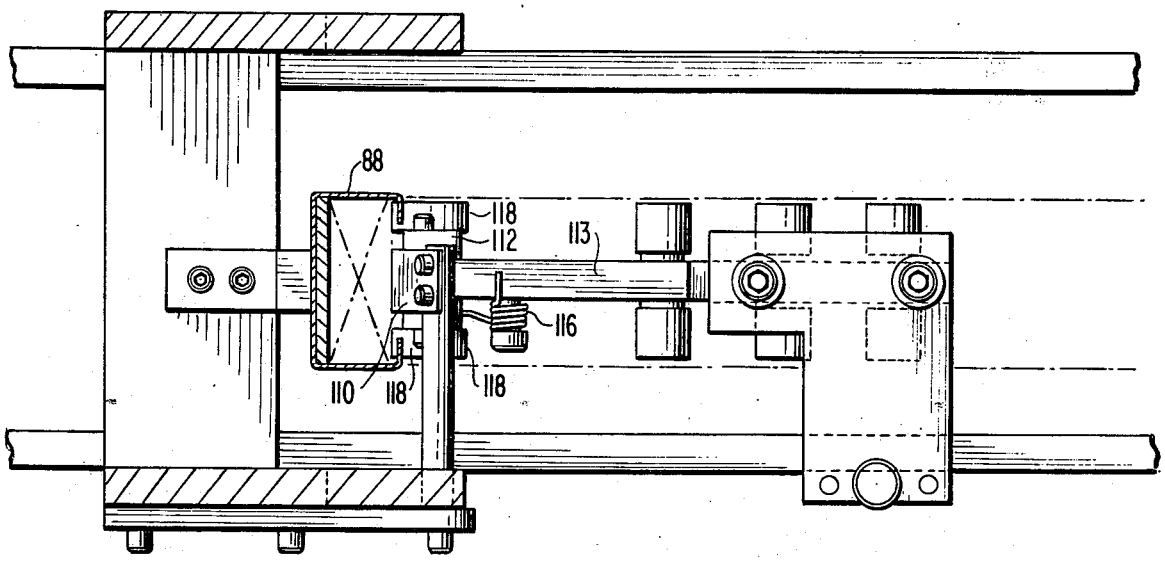
FIG. 25 is a cross-sectional view of the embodiment of FIG. 23 taken along lines B—B.

As here embodied, and most clearly depicted in FIGS. 23, 24 and 25, the receptacle 12 is rotated about the closure portion 16 by the continued conveying of the blank 26 through the apparatus subsequent to the affixing of the receptacle 12 to the blank 26.

The apparatus preferably includes a pivoted member 112 for controlling rotation of the receptacle. The member 112 is pivotally affixed to a support 113 at one extremity 114 adjacent the receptacle when the receptacle is in a vertical position within the guide member 88 prior to contact with the closure portion. The opposite extremity of the pivoted member 112 includes a roller 118 that bears on the receptacles as they rotate about the closure member as indicated in phantom lines of FIG. 23. The pivoted member 112 contacts the receptacle 12 due to the force provided by a spring 116. The pivotally mounted member 112 insures the rotation of the receptacle to the appropriate position while preventing scoring or damaging of the surface of the receptacle during its rotation.

In accordance with the invention, means for affixing portions of the closure member to the receptacles are provided. The apparatus as disclosed herein utilizes the application of adhesive to portions of the components passing thereto in relation to their position within the apparatus. Such technology is only peripherally associated with the invention disclosed and one skilled in the art can readily devise specific means to apply adhesive to the appropriate components of the carton without a specific teaching herein.

Figure 12:
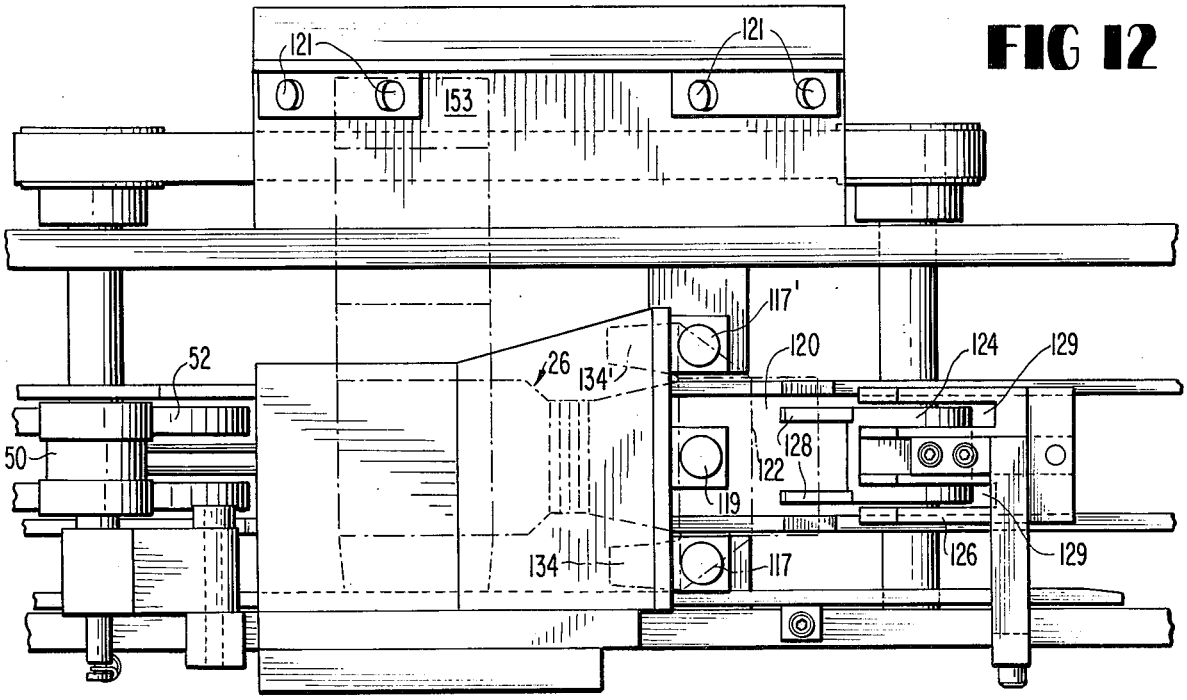
FIG. 12 is a top view of an embodiment of the apparatus having means for folding the preceding portion of the closure portion of the blank.
Figure 13:
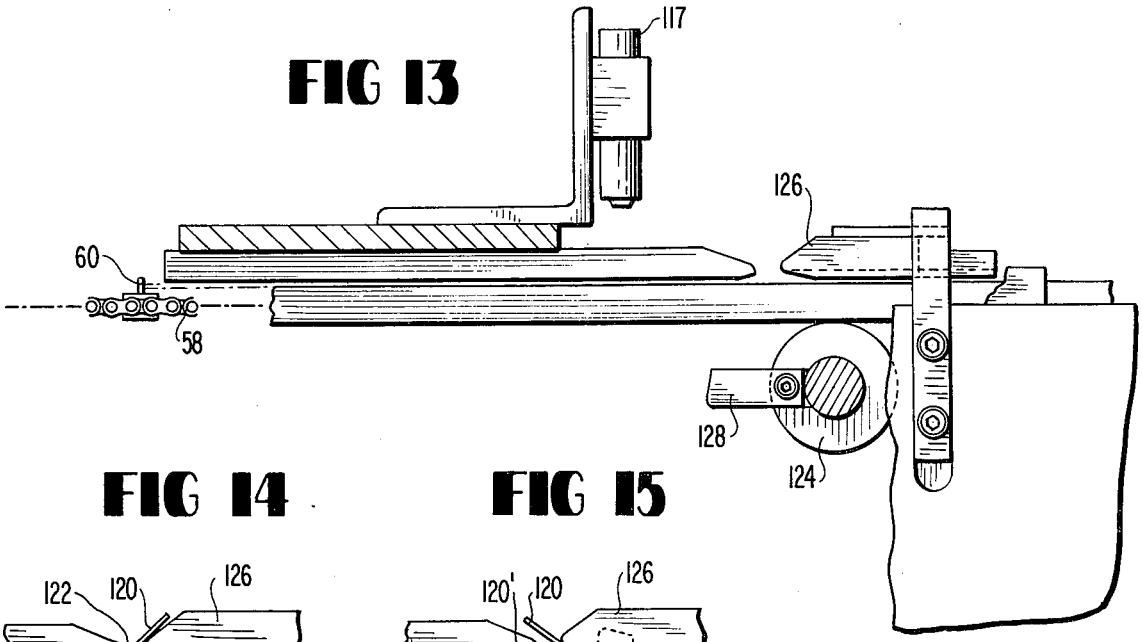
FIG. 13 is a partial cross-section of the embodiment of FIG. 12.
Figure 18:
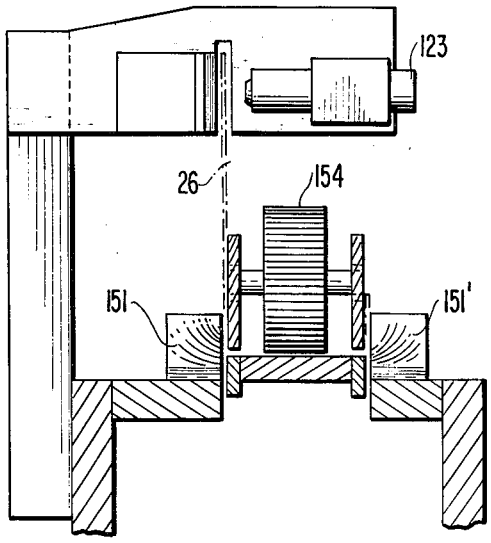
FIG. 18 is a partial cross-section of the embodiment of FIG. 17 along lines XVIII—XVIII.

The specific subsystem used for applying adhesive to portions of the closure member 14 utilizes photocell detectors and the pneumatically actuated application of adhesive. In FIG. 12 four photocell detectors (not shown) mounted in the openings 121 detect the leading and trailing edge of the overlapping portion 153 of the slide portion 20. In response to the position of the blank within the device, as determined by the photocells, adhesive is applied to appropriate portions of the blank. In the embodiment depicted in FIGS. 12 and 13, adhesive is applied to the glue flaps 134 and 134' by the adhesive spray nozzles 117 and 117' respectively. Adhesive is applied to the top panel 120' by the adhesive spray nozzle 119. As depicted in FIGS. 17 and 18, after the first side portion 143, the top wall panel 147 and the overlapping side portion 153 are folded to a vertical position adhesive is applied to the overlapping side portion 153 by the adhesive spray nozzle 123. All the adhesive spray nozzles depicted are in flow communication with the supply of adhesive and are electrically interfaced to a control system receiving input information on the location of the blanks from the various photocell detectors.

In the embodiment depicted the closure portion is given a preferred shape by applying adhesive to either the glue flap 120 or the top panel 120' and subsequently folding the glue flap 120 over along a common fold line as will be hereinafter disclosed. In addition, adhesive is preferably applied to the trailing glue flaps 134 and 134' with those glue flaps providing the means of attachment of the closure portion 14 to the receptacle 12. The trailing glue flaps are disposed to contact the lowermost portion of one side of the receptacle 12 affixing the closure portion thereto.

In the preferred configuration of the blank 26 depicted in FIG. 4, the blank includes two rectangular flaps, glue flap 120 and top panel 120' with the glue flap 120 preceding the top panel 120' on the blank 26. The flap 120 and the panel 120' are joined along their common longest dimension by a first fold line 122.

The apparatus for utilizing such a blank configuration includes means for folding the glue flap 120 along the first fold line 122 and placing the glue flap 120 above the top panel 120'. The apparatus further includes means for affixing the two together which normally consists of applying adhesive to either the top panel or the glue flap.

Figure 14:
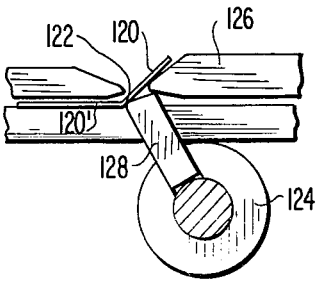
FIGS. 14 and 15 illustrate the operation of the flap folding embodiment of FIGS. 12 and 13.
Figure 15:
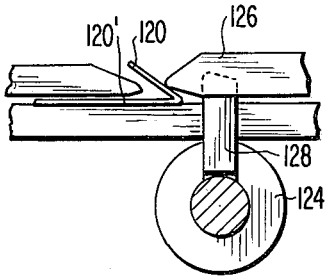

As here embodied and depicted in FIGS. 12 through 15, the folding means comprise a rotationally drive folding member 124 which having a projection 128 attached thereto. The member 124 is driven synchronously with the conveying means beneath the path of the blank 26 through the apparatus. As depicted in FIGS. 14 and 15, the projection 128 on the folding member 124 contacts only the rectangular glue flap 120 forcing it upward into contact with a first deflection member 126. The deflection member 126 folds the upwardly projecting glue flap 120 about the first fold line 122 from its original position on the blank 26, 180 degrees into contact with the top panel 120' as the blank is being conveyed through the apparatus. The projection 128 passes through grooves 129 in the deflection member 126 thereby allowing the projection 128 to project significantly above the path along which the blank 26 is being conveyed without the projection 128 interfering with the deflection member 126.

In the embodiment where the blank is initially planar, a further preferred embodiment of the closure portion includes two opposite side panels 130 and 130' affixed at each lengthwise extremity of the top panel 120 at opposite top fold lines 132 and 132'. Each of the end flaps have a trailing glue flap 134 and 134' affixed to each side panel 130' at side fold lines 136 and 136'. The side fold lines 136 and 136' are at 90° from the top fold lines 132 and 132' and are parallel to the first fold line 122 when the blank is planar.

When the receptacle is brought into abutting contact with the closure portion, means are provided for folding the trailing glue flaps 134 and 134' along the side fold lines 136 and 136' into contact with the lowermost portion of the receptacle.

As here embodied and depicted in FIGS. 21, 23, and 26, the means for folding the trailing glue flaps 134 and 134' comprise a pair of opposed elongated arms 142 and 142' on opposite sides of the closure portion. Each of the arms is centrally pivoted moving on a plane parallel to the side of the receptacle on which the trailing glue flaps are to be affixed. First extremities 144 and 144' on the arms 142' are parallel to the surface of the receptacle to be contacted by the trailing glue flaps. The folding means also includes a cam 146 synchronously engaged to the conveying means. One extremity 148 of the arm 142 contacts the cam 146 with the cam selectively imparting motion to the arms 142 in response to the contour of the cam 146. Preferably, the cam 146 is disc-shaped with at least one lobe 150 on each side of the disc disposed to displace the extremities 148 and 148' of the arms 142 and 142' thereby moving the arms and hence the extremities 144 and 144' in a direction parallel to the side of the receptacle when the receptacle is vertically disposed.

As depicted herein the arms 142 and 142' include rollers 149 and 149' disposed to contact lobes 150 and 150' on the disk 146. It is also preferred that the extremities 144 and 144' of the arms 142 and 142' include horizontal portions 145 and 145' parallel to the side of the receptacles when it is vertically disposed. The innermost edges of extremities 144 and 144' are preferably beveled in an angle approximately 10° from the vertical. The function of the bevel on the innermost portions of the extremities 144 and 144' is the enhance the high speed operation of the apparatus and prevent the hangup of the trailing flue flaps 134 and 134' on the hinge portion 22 of the blank 26.

Figure 16:
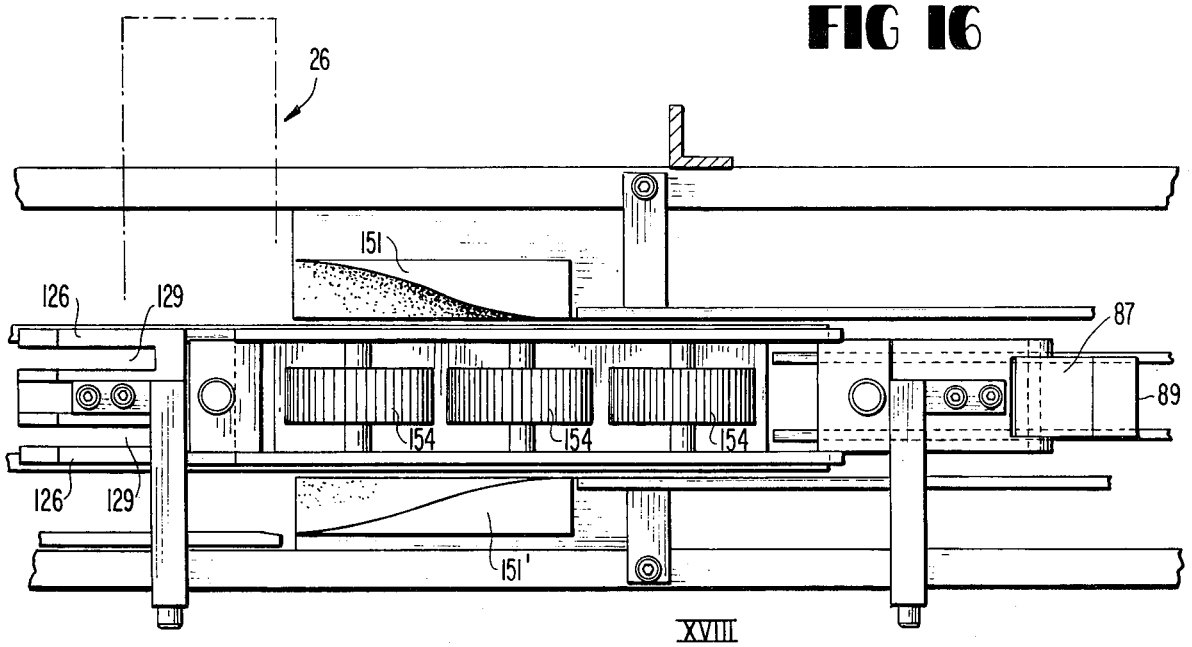
FIG. 16 is a top view of the apparatus illustrating means for elevating portions of the closure portion and slide portions as the blank is transported through the apparatus.

In accordance with the invention, means are provided for wrapping and affixing the slide portion around the receptacle. As here embodied and most clearly depicted in FIGS. 16 through 18 and FIG. 26, the apparatus includes various deflecting means for manipulating the slide portion into a vertical position and thereafter wrapping it around the receptacle. As depicted in FIG. 16 and FIG. 18, flap deflecting members 151 and 151' are interposed along the path through the apparatus. The movement of the blank in contact with the deflecting member 151 and 151' elevates the side panels 130 and 130' and the trailing glue flaps 134 and 134' as well as portions of the slide portion. The remainder of the blank 26 is held in a horizontal plane by a plurality of elastomeric compression rolls depicted in FIGS. 16, 17 and 18 as compression rolls 154. In the embodiment depicted, the receptacle is placed and affixed to the closure portion of the blank with the side panels and the slide portion in the configuration shown, in end view, in FIG. 18. After the receptacle is placed therein, however, it is rotated and further conveyed through the apparatus with the closure member 14 affixed to the receptacle 12, the slide portion is wrapped around the receptacle by means of deflection bar 160 and side deflector 152. The components having previously received adhesive in the appropriate location, the placement of the slide portion in the final configuration completes the assembly of the package. As depicted in FIG. 26, the package is moved through a close fitting guide section thereby restraining the components to the correct configuration of the package allowing any adhesive in the package to set with the package in the appropriate configuration.

OPERATION OF THE PREFERRED EMBODIMENT

The package 10, depicted in FIG. 1, is assembled from the receptacle 12 and a closure member 14. Basically the method of assembly comprises the joining of the closure member 14 to the receptacle 12.

Figure 29:
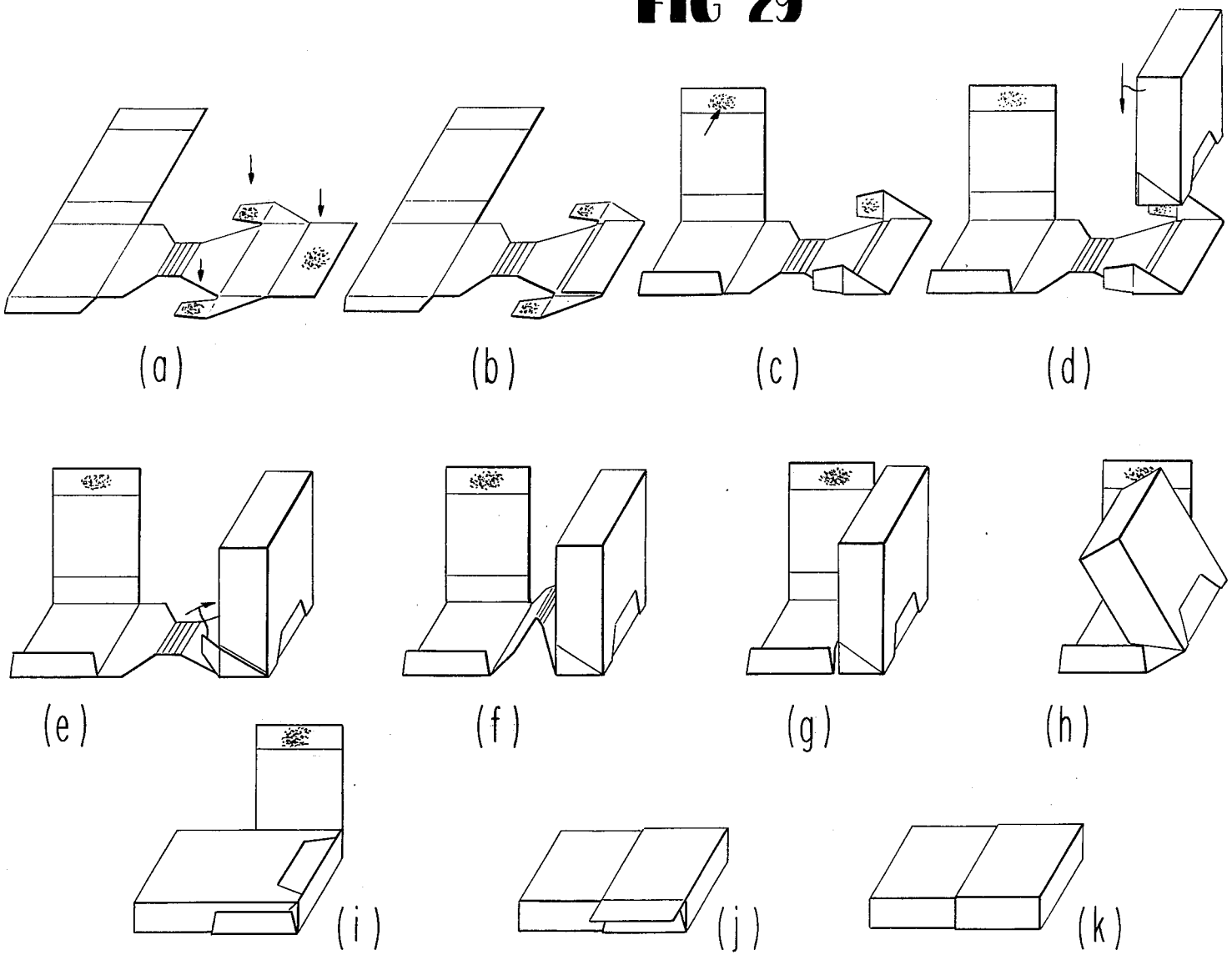
FIG. 29 is a schematic representation of the method of the present invention.

A sequence of operation comprising the preferred method of joining the two components is depicted in FIG. 29 in steps (a) through (k). The components depicted therein are in a preferred configuration with the blank 26 having the shape depicted in FIG. 4. While the method of disclosed in terms of a preferred embodiment of the blank 26 comprising the closure member 14, it should be recognized that the method is applicable to closure members of different shapes and configurations. The necessary components for the closure member 14 include: a closure portion, depicted in FIG. 4 as 16, that ultimately fits over the open portion 18 of the receptacle; slide portion 20 for surrounding the receptacle and a rolling hinge portion 22 which connects the slide portion and the closure portion.

In the preferred embodiment shown, the closure portion 16 of the blank 26 includes two rectangular portions, glue flap 120 and top panel 120'. The glue flap 120 precedes the top panel 120' on the blank. The glue flap and the top panel are joined along their common longest dimension by a first fold line 122. As was previously disclosed, the apparatus includes means for folding the glue flap 120 along the first fold line 122 to place the glue flap 120 over the top panel 120'. Also included in the apparatus are means for affixing the flue flap to the top panel, the means simply being the application of adhesive to the glue flap 120 depicted schematically in FIG. 29(*a*).

The preferred blank 26 also includes two opposite side panels 130 and 130' affixed at each lengthwise extremity of the top panel 120'. The side panels are affixed to the top panel 120' by top fold lines 132 and 132'. Each of the side panels have trailing glue flaps 134 and 134' affixed thereof at side fold lines 136 and 136'. The side fold lines are parallel to the first fold line 122 when the blank is planar.

Where the carton is rectangular in cross-section, the portion of the blank forming the slide portion 20 is preferably comprised of a bottom wall panel 140 which includes a trailing edge 141 that normally contacts the drive means conveying the blank through the apparatus. First side portion 143 and a second side portion 137 are located on either side of the bottom wall panel 140. A top wall panel 147 is affixed along a fold line 139 to the first side portion 143. An overlapping side portion 153 is disposed to overlap the second side portion 137 when the slide portion is formed around the receptacle 12.

The preferred blank structure 26 is assembled and joined to the receptacle 12 in a sequence of operations depicted in FIG. 29 (*a*) through (*k*). As depicted in FIG. 29(*a*), the blank 26 is moved along a path with the closure portion preceding the remainder of the blank. Preferably, the trailing edge 141 moves the blank through the apparatus by engagement with a drive means. In the preferred method of operation with the blank in a configuration depicted, adhesive is applied to the glue flap 120 and the two trailing glue flaps 134 and 134' as depicted in FIG. 29(*b*). The glue flap 120 is folded 180° about fold line 122 into contact with the top panel 120'. The adhesive placed therebetween keeps the top panel and glue flap in such a configuration. As depicted in FIG. 29(*c*), the side panels 130 and 130', as well as the attached trailing glue flaps 134 and 134', are elevated to a vertical position. In addition, the first and second side portions 143 and 137 respectively of the slide portion 20, as well as the top wall panel 147 and the overlapping portion 153, are elevated to vertical positions, and in this preferred method, adhesive is applied to the overlapping portion 153 when it is in the vertical position depicted. Next, the open end 18 of the receptacle 12 is placed into a contacting relation with the closure portion 16 with the receptacle extending normally from the path of movement of the blank as depicted in FIG. 29(*d*). Portions of the closure portion 16, embodied here as the trailing glue flaps 134 and 134' with adhesive thereon, are placed in contact with the receptacle thereby affixing the closure portion to the receptacle.

As depicted in FIG. 29(*f*) and (*g*), the closure portion is momentarily abutted to compress and buckle the rolling hinge portion 22 thereby moving the hinge portion out of the path defined by the blank as it moves through the apparatus. The hinge portion 22 buckles by the formation of a first fold along fold line 133 due to the presence of the receptacle abutting the glue flap 120 affixed to top panel 120'. Continued compression of the hinge portion 22 forces the rolling hinge 23 to rise vertically forming a second fold in the rolling hinge 23. The edge of the rolling hinge portion 22 folds at the fold line 135 due to the fold limiting member 87 preventing vertical movement of the bottom wall panel 140 thereby placing the rolling hinge portion out of the plane of the blank.

As depicted in FIG. 29(*h*) and (*i*), the receptacle 12 is thereafter rotated into a contacting relation with the rolling hinge portion 22 and the bottom wall panel 140. As depicted in FIG. 29 (*i*) through (*k*), the panels comprising the slide are wrapped around the receptacle 12 and affixed to allow reciprocating movement of the slide toward and away from the open topped portion 18 of the receptacle.

In the embodiment depicted, the overlapping portion 153 of the slide portion is placed in contact with the second side portion 137 and affixed thereto, providing reciprocating movement of the slide portion 20 along the length of the receptacle 12.

Preferably, the method of forming the package includes the step of disengaging the trailing edge 141 of the slide from the first drive means by a second drive means, with the second drive means moving the package at a greater speed along the path of movement through the apparatus than the first drive means.

Similarly it is preferred that a third drive means engaging the sides of the package disengage the package from the second drive means. By use of multiple drive means of progressively increasing speed the package can be conveyed and disengaged from previous drive means without marring or damaging the surface. This is significant to the present invention since the drive means conveying the package and its components through the device during assembly must positively engage them due to the numerous synchronous high speed operations. The third drive means need not use positive engagement thereby tolerating some slippage since the timed operations on the package are essentially complete at the point the third drive means engages the package.

Preferably, assembly of the package would also include the restraining of portions of the package subsequent to the application of adhesive to allow the adhesive to set with the package in the correct configuration.

The invention has been disclosed herein as a method and an apparatus for assembling a package from two basic components. While the configuration of the components depicted is preferred, the invention is applicable to other component configurations, and the scope of the invention is not intended to be limited to the embodiment depicted but rather by the scope of the appended claims.

What is claimed is:

1. A method of assembling a package comprised of an open-topped receptacle and a slide-actuated closure member, said closure member being formed from a blank, said closure member having a closure portion disposed to fit over the open portion of said receptacle, a slide portion for surrounding said receptacle and a rolling hinge portion connecting said slide portion and said closure portion, the steps comprising:

a. moving said blank along a path;
b. placing the open end of said receptacle into contacting relation with said closure portion with said receptacle extending generally normally from said path;
c. affixing portions of said blank to said receptacle;
d. moving said hinge portion out of the plane of said path;
e. rotating said receptacle into a contacting relation with said rolling hinge portion and said slide portion;
f. wrapping said slide portion around said receptacle; and
g. affixing said slide portion around said receptacle to allow reciprocating movement of the slide portion toward and away from said open portion of said receptacle.

2. The method of claim 1 wherein the closure portion of the blank precedes the remainder of the blank, and the movement of the closure portion is momentarily interrupted while moving the remainder to move the hinge portion out of the plane of said path.

3. The method of claim 1 wherein a portion of the closure portion is horizontally disposed to receive thereon, the open portion of said receptacle to cover said portion, said receptacle being disposed above said portion of the closure portion.

4. The method of claim 3 wherein the movement of the blank is interrupted to receive said receptacle.

5. The method of claim 4 wherein the closure portion of the blank precedes the remainder of the blank and the remainder of the blank is moved after the interruption of movement while holding the closure member in place to move the hinge portion upwardly out of the horizontal plane of the movement path.

6. The method of claim 1 wherein the receptacle is rotated by commencing movement of said closure portion after interruption thereof while momentarily blocking the movement of the receptacle.

7. The method of claim 2 wherein said blank is moved horizontally by first drive means beneath said blank engaging the trailing edge of said slide portion.

8. The method of claim 7 including the step of disengaging said trailing edge from said first drive means by a second drive means moving said package at a greater horizontal speed than said first drive means.

9. The method of claim 8 wherein said second drive means engages the bottom of said receptacle after rotation of said receptacle.

10. The method of claim 9 including the step of disengaging said package from said second drive means by a third drive means moving said package at a greater horizontal speed than said second drive means after the affixing of said slide portion around said receptacle.

11. The method of claim 1 including the step of supplying said individual components in the form of planar blanks.

12. The method of claim 1 wherein the steps of affixing comprise application of adhesive, said method including restraining portions of said package subsequent to application of said adhesive to allow said adhesive to set with said package in the correct configuration.

13. A method of assembling a package comprising an open-topped receptacle and a slide actuated closure member, said closure member being formed from a blank comprising a closure portion, a slide portion and a rolling hinge portion, said slide portion being comprised of front and rear wall panels and first, second and thrid side wall panels, said front wall panel having first and second side wall panels connected to its respective sides by fold lines, said rear wall panels being connected by fold lines to the opposite side of said second side panel and said third side panel being connected by a fold line to the other side of said rear wall panel, said rolling hinge portion being comprised of a hinge panel and a foldover panel connected by a series of folding panels positioned between said hinge panel and said foldover panel, said folding panel being interconnected by fold lines and the outermost fold panels being connected by fold lines respectively to the hinge panel and the foldover panel, said foldover panel being connected by a fold line to the top edge of the rear wall panel of the slide portion, said closure portion being comprised of a top panel, a pair of side panels connected by fold lines respectively to the opposite ends of said top panel, the side of said top panel adjacent said side panels being connected by a fold line to said hinge panel, said closure member further comprising glue flaps connected to the side of said side panels adjacent the fold lines connecting side panels to the top panels and the fold line connecting the top panel to the hinge panel, the steps comprising:

a. moving said blank along a path,
b. folding the side and front panels of the slide portion normally to the movement path,
c. folding said side panels and glue flaps of said closure portion normally to the movement path,
d. placing the open end portion of said receptacle between the side panels of said closure portion and in contacting relation to said top panel of said portion,
e. applying adhesive to said glue flaps on the closure portion and folding said flaps into contacting relation to the rear wall of said receptacle to adhere said flaps thereto,
f. folding said rolling hinge portion out of the plane of movement of the blank such that folding occurs along the fold lines connecting the top panel of the closure member to the hinge panel, the rear wall panel of the slide portion to the foldover panel and along at least one of the fold lines associated with the folding panels,
g. moving said slide portion into a position adjacent said closure portion with said rolling hinge portion folded, the hinge panel being adjacent the rear wall of the receptacle,
h. rotating said receptacle into contacting relation to the hinge panel of the rolling hinge portion, said foldover panel being in contact with the rear wall panel of the slide portion,
i. folding said slide portion around receptacle whereby said first and third side panels of said slide portion are adhered into overlapping contacting relation.

14. A method of assembling a package as recited in claim 13 wherein said closure portion precedes the remainder of the blank in movement along the path and wherein said rolling hinge portion is folded by movement of the slide portion at a greater speed than that of the closure portion.

15. A method of assembling a package as recited in claim 14 wherein the hinge portion is folded by movement of the slide portion while retaining the closure portion at rest.

16. A method of assembling a package as recited in claim 15 wherein the blank is brought to rest to receive the receptacle.

17. A method of assembling a package as recited in claim 16 wherein the slide portion and hinge only are moved after the rest position to cause a folding of the hinge portion.

18. A method of assembling a package as recited in claim 13 wherein the blanks are moved along a horizontal path and the receptacles extend vertically above said blanks when placed on the closure portion.

19. A method of assembling a package as recited in claim 13 wherein the receptacle is rotated by movement of the open end thereof with the moving blank while restraining the opposite end of said receptacle.

20. An apparatus for assembling a package, said package being comprised of an open-topped receptacle and a slide-actuated closure member, said closure member being formed from a blank with a closure portion disposed to fit over the open portion of said receptacle, a slide portion connecting said slide portion and said closure portion, said apparatus comprising:

a. means for supplying said blanks individually,
b. means for conveying said blanks along a path through said apparatus,
c. means for folding said hinge portion thereby displacing said hinge portion from the plane of said path;
d. means for placing said receptacles normal to said path synchronous with said conveying means to place the open top of said receptacles into a contacting relation with said closure portion;
e. means for affixing portions of said closure member to said receptacle;
f. means for rotating said receptacle about said closure portion to place one side of said receptacle in contact with said hinge portion, said hinge portion and said receptacle being in overling relation to said slide portion;
g. means for wrapping said slide portion around said receptacle; and
h. means for affixing said slide portion around said receptacle.

21. The apparatus of claim 20 wherein said means for folding said hinge portion is comprised of means for moving the slide and hinge portions of said blank at a greater speed than said closure portion.

22. The apparatus of claim 20 including means for interrupting the movement of said blank along said path to permit placement of said receptacle on the closure portion and means for commencing movement of the slide and hinge portions before movement of said closure portion to fold said hinge portion.

23. The apparatus of claim 22 wherein said means for rotating said receptacle is comprised of means for retaining the end of said receptacle opposite said open end portion in position when the open end portion and the closure portion commence movement after placement of the receptacle on the closure portion.

24. The apparatus of claim 20 wherein said closure portion of said blank comprises a top panel and a glue flap connected to said top panel by a fold line extending transverse of the movement path, said glue flap preceding said top panel in movement along said path and wherein said apparatus includes means for applying adhesive to one of said top panels or glue flap and means for folding said glue flap along said fold line to place said glue flap over said top flap whereby said glue flap is adhered to said top panel.

25. The apparatus of claim 24 wherein the glue flap folding means comprises a folding member rotating synchronously with said conveying means, said folding member contacting only said glue flap from beneath said blank forcing said glue flap upwardly, said flap folding means further including a first deflection means for deflecting said upwardly projecting glue flap 180° from the original position on said blank into contact with said top panel as said blank is being conveyed through said apparatus.

26. The apparatus of claim 20 wherein said blank is initially planar and said closure portion further includes two side panels connected by side fold lines on opposite sides of said top panel, said side panels each having a trailing glue flap connected by trailing fold lines; wherein said apparatus includes means for elevating said side panels to a vertical position, said receptacle being placed between said side panels of the closure portion and wherein said apparatus includes means for elevating said side panels and said trailing glue flaps to a vertical position, said receptacle being placed between said side panels of the closure portion; and means for folding said traling glue flaps along the side fold lines connecting said end flaps to said side panels placing said trailing glue flaps in contact with the lowermost portion of one wall of said receptacle.

27. The apparatus of claim 26 including means for placing adhesive on said trailing glue flaps prior to their contact with said wall of said receptacle.

28. The apparatus of claim 26 wherein said means for folding said trailing glue flaps comprise a pair of opposed elongated arms on opposite sides of said path, each of said arms being centrally pivoted in a direction transverse of said path, the first extremity of said arm being transverse to said path and disposed to selectively contact said trailing glue flaps, said folding means further including at least one cam synchronously engaged to said conveying means, the second extremity of each of said arms contacting said cam and selectively imparting motion to said arms in response to the contour of said cam.

29. The apparatus of claim 20 wherein said conveying means comprises a driven chain, said chain having affixed thereon a plurality of projections for engaging an edge of said slide portion.

30. The apparatus of claim 21 wherein said means for momentarily engaging said closure portion comprises: a pivotally mounted engaging arm extending below said path and a cam rotating synchronous with said conveying means in contact with said engaging arm for moving said engaging arm vertically upward in response to the position of said cam, the upward vertical movement of said engaging arm sufficient to place said arm in engagement with said closure portion of said blank.

31. The apparatus of claim 21 including a pivoted member for controlling rotation of said receptacle, said member being pivotally affixed at its upper extremity spaced above said path projecting downwardly therefrom, the lower extremity of said pivoted member bears on said receptacles as they rotate.

32. The apparatus of claim 31 wherein the lower extremity of the rotating control member includes a roller for rolling engagement with the side of the receptacle as it is rotated.

33. The apparatus of claim 32 wherein a spring bears against the rotation control member to impose pressure on the side of the receptacle as it rotates.

34. The apparatus of claim 20 comprising first, second and third conveying means, the first conveying means engaging the trailing edge of the slide portion, the second conveying means disposed to engage the bottom of said receptacle when said receptacle is moving along said path, said second conveying means moving said package at a greater speed along said path than said first conveying means thereby disengaging said closure member from said blank conveying means, said third conveying means disposed to convey said packages after folding of the slide portion about the receptacle at a speed in excess of that provided by said second conveying means.

35. The apparatus of claim 34 wherein said third conveying means comprise a pair of driven opposed fabric belts contacting said package on opposite sides thereof, said belts being driven independent from said first conveying means.

36. The apparatus of claim 29 wherein said dispensing means comprise: a storage frame for maintaining each of said blanks horizontally in a vertical stack; a blank engaging member for having a portion for contacting said bottommost blank and orifices in said portion for selectively applying a vacuum to said blank thereby selectively affixing said bottommost blank to said blank contacting portion; an elongated actuating member linked to said engaging member for selectively moving individual blanks affixed to said contacting portion to a predetermined location; and means at said location for placing said blank into engagement with said first conveying means.

37. The apparatus of claim 36 wherein said actuating member is driven by means synchronously linked to said first conveying means.

38. The apparatus of claim 37 wherein said elongated actuating member includes a roller at the extremity of said member opposite said blank engaging member, said dispensing means including a slot surrounding said roller for imparting vertical and horizontal movement to said blank engaging member as said roller is moved within said slot; and a driving member engaging said actuating member between said blank engaging member and said roller for driving said roller within said slot.

39. The apparatus of claim 38 wherein said driving member is comprised of a guide member and a sliding member engaged thereon, one extremity of said guide member being pivotally mounted with said sliding member slideably engaging to said guide member and said elongated actuating member, a first rotating cam contacting said sliding member, said cam being synchronously engaged to said first conveying means and disposed to move said sliding member and thereby said actuating member in response to the position of said sliding member on said cam and the shape of said slot.

40. The apparatus of claim 39 including a pivotally mounted blank driving roller for transporting said blank from said blank engaging means into engagement with said first conveying means, a second cam synchronously driven with said first cam raising said roller allowing said blank engaging means to insert said blank past said roller prior to said roller engaging said blank.

41. The apparatus of claim 20 wherein said means for placing said receptacles normal to said path comprises: a vertically disposed guide member for confining a plurality of said receptacles in a downward progression with said receptacles oriented end to end within said guide member, said guide member having upper and lower extremities, said lower extremity of said guide member terminating a distance above conveying means to allow passage of said closure member thereunder, the upper extremity of said guide member being adapted to receive individual receptacles; first receptacle drive means adjacent said upper extremity placing said individual receptacles within said guide member, said first receptacle drive means comprising a generally circular rotationally driven disc having an indented circumferential surface, said disc being driven synchronous with said conveying means; receptacle supply means supply individual receptacles to the indentation on said disc with rotation of said disc placing said receptacles within said guide member; and second receptacle drive means on said guide member for driving said receptacles downward through said guide member, said second drive means comprising a driven elastomeric roller contacting one surface of said receptacles, said second drive means being synchronously driven with said rotationally drive disc.

42. The apparatus of claim 41 including control means interacting with said blanks passing through said apparatus, said control means being capable of interrupting the supply of said receptacles if the supply of said blanks is interrupted.

43. The apparatus of claim 42 including means for preventing movement of the receptacles through said guide member except by the action of said first and second receptacle drive means.

44. The apparatus of claim 43 wherein said movement preventing means comprise a spring in contact with the surface of the receptacle.

* * * * *